US010117454B2

(12) United States Patent
Ademe et al.

(10) Patent No.: US 10,117,454 B2
(45) Date of Patent: Nov. 6, 2018

(54) TOBACCO SLITTING MACHINE

(71) Applicant: R.J. Reynolds Tobacco Company, Winston-Salem, NC (US)

(72) Inventors: Balager Ademe, Winston-Salem, NC (US); John Larkin Nelson, Lewisville, NC (US)

(73) Assignee: R.J. REYNOLDS TOBACCO COMPANY, Winston-Salem, NC (US)

( * ) Notice: Subject to any disclaimer, the term of this patent is extended or adjusted under 35 U.S.C. 154(b) by 241 days.

(21) Appl. No.: 14/940,771

(22) Filed: Nov. 13, 2015

(65) Prior Publication Data

US 2017/0135393 A1 May 18, 2017

(51) Int. Cl.
*A24C 5/36* (2006.01)

(52) U.S. Cl.
CPC ..... *A24C 5/36* (2013.01)

(58) Field of Classification Search
CPC .... A24C 5/36; A24C 5/28; A24C 5/32; A24C 5/34; A24C 1/04; A24C 1/045; A24C 5/14; A24C 5/30; A24C 5/31; A24C 5/322; A24C 5/326; A24C 5/345; B65G 47/74; B65G 47/763
USPC ..... 131/96
See application file for complete search history.

(56) References Cited

U.S. PATENT DOCUMENTS 3,339,559 A * 9/1967 Rupert ..... A24C 5/36 131/96
4,554,931 A * 11/1985 Born ..... A24C 5/28 131/280
4,763,673 A * 8/1988 Barnes ..... A24C 5/36 131/94
4,815,481 A * 3/1989 Hirose ..... A24C 5/471 131/94
4,867,179 A 9/1989 Leonard
5,076,291 A * 12/1991 Grove ..... A24C 5/36 131/96
5,086,790 A 2/1992 Greene, Jr.
5,117,843 A 6/1992 Holmes et al.
5,234,007 A 8/1993 Holmes et al.
6,514,014 B1 * 2/2003 Holmes ..... A24C 5/345 131/109.3

(Continued)

FOREIGN PATENT DOCUMENTS

DE 102013200717 A1 * 7/2014 ..... A24C 5/28
GB 850332 A * 10/1960 ..... A24C 5/36
GB 1103929 A * 2/1968 ..... A24C 5/36

*Primary Examiner* — Michael J Felton
*Assistant Examiner* — Sonny V Nguyen
(74) *Attorney, Agent, or Firm* — Foley & Lardner LLP

(57) ABSTRACT

Provided herein is a tobacco recovery machine that automatically removes and separates a tobacco rod from formed cigarettes and slits the tipping paper surrounding the tobacco rod. The tobacco recovery machine includes a hopper that receives cigarettes. A feed mechanism individually feeds the cigarettes from the hopper and through a chopping mechanism that removes the filter rod from each cigarette leaving the cylindrical tobacco rod wrapped in the tipping paper. The tobacco recovery machine next feeds the tobacco rod of the cigarette through a slitting mechanism that slits the tipping paper wrapping surrounding the tobacco. The slitting mechanism axially slits the tipping paper along the tobacco rod such that the tobacco product can separate from the tipping paper.

18 Claims, 19 Drawing Sheets

(56) References Cited

U.S. PATENT DOCUMENTS

| | | | | |
|---|---|---|---|---|
| 7,296,578 | B2 | 11/2007 | Read, Jr. | |
| 7,434,585 | B2 | 10/2008 | Holmes | |
| 7,775,217 | B2 | 8/2010 | Seymour et al. | |
| 2011/0220129 | A1* | 9/2011 | Sieredzinski | A24C 5/36 131/96 |
| 2014/0290671 | A1* | 10/2014 | Park | A24C 5/36 131/96 |

* cited by examiner

TOBACCO SLITTING MACHINE

FIELD OF THE DISCLOSURE

The present disclosure relates to a slitting machine.

DISCLOSURE OF RELATED ART

Cigarettes typically are cylindrical in shape and include a filter rod and a tobacco rod having tobacco product formed into a cylindrical shape and wrapped in a tipping paper. The tipping paper maintains the shape of the tobacco rod during product packaging and product use. During manufacturing of cigarettes, machines are used to form the cigarettes and to place the formed cigarettes into appropriate packaging (e.g., boxes, cartons, etc.). See, for example, U.S. Pat. No. 7,296,578, U.S. Pat. No. 7,434,585, and U.S. Pat. No. 7,775,217, each of which show cigarette manufacturing machines, and each of which are incorporated herein by reference.

Often times, cigarettes are placed in packages that may become damaged or may be opened for quality control inspection and/or product testing. In these cases, the cigarettes within the packages used for inspection and/or testing are not sold to end users. However, the tobacco product contained within each cigarette is still usable. Accordingly, it is desirable to recover the tobacco product from these cigarettes. To do so, the tobacco rod needs to be separated from the filter rod, and the tipping paper needs to be opened to allow the tobacco product to be separated from the tipping paper. See, for example, U.S. Pat. No. 4,867,179, U.S. Pat. No. 5,086,790, U.S. Pat. No. 5,117,843, and U.S. Pat. No. 5,234,007, each of which are incorporated herein by reference. However, these machines have their drawbacks. The machines can be inefficient and/or not complete (i.e., not perform the entire separation of the tobacco such that the tobacco can be reused).

Accordingly, it would be desirable to provide a system and method for more easily and efficiently separate the usable tobacco from the filter rod and the tipping paper.

SUMMARY

The above and other needs are met by aspects of the present disclosure which, in a first aspect, provides a tobacco recovery machine. The tobacco recovery machine includes a feeder configured to individually transport a plurality of cigarettes past a chopping mechanism. Each of the cigarettes includes a filter rod and a tobacco rod surrounded by tipping paper. The chopping mechanism includes a chopping knife configured to separate the filter rod from the tobacco rod. The tobacco recovery machine further includes a transportation mechanism having a belt drive system and a guide rail. The transportation mechanism is configured to receive the tobacco rod surrounded by the tipping paper after the filter rod has been separated from the tobacco rod by the chopping mechanism and to transport the tobacco rod surrounded by the tipping paper past a slitting mechanism. The slitting mechanism includes a slitting knife oriented to axially slit the tipping paper surrounding the tobacco rod as the tobacco rod is transported past the slitting mechanism by the transportation mechanism.

In second aspect, a method of recovering tobacco from a plurality of cigarettes with a tobacco recovery machine is provided. Each of the cigarettes includes a filter rod and a tobacco rod surrounded by tipping paper. The method includes individually transporting, by a feeder, each of the plurality of cigarettes to a chopping mechanism. The method further includes separating, by a chopping knife of the chopping mechanism, the filter rod from the tobacco rod for each of the plurality of cigarettes. The method includes transporting, by a transportation mechanism including a belt drive system and a guide rail, the tobacco rod surrounded by the tipping paper to a slitting mechanism. The method further includes slitting, by a slitting knife of the slitting mechanism, the tipping paper surrounding the tobacco rod as the tobacco rod is transported past the slitting mechanism by the transportation mechanism.

Further features and advantages of the present disclosure are set forth in more detail in the following description.

BRIEF DESCRIPTION OF THE DRAWINGS

Figure 1:
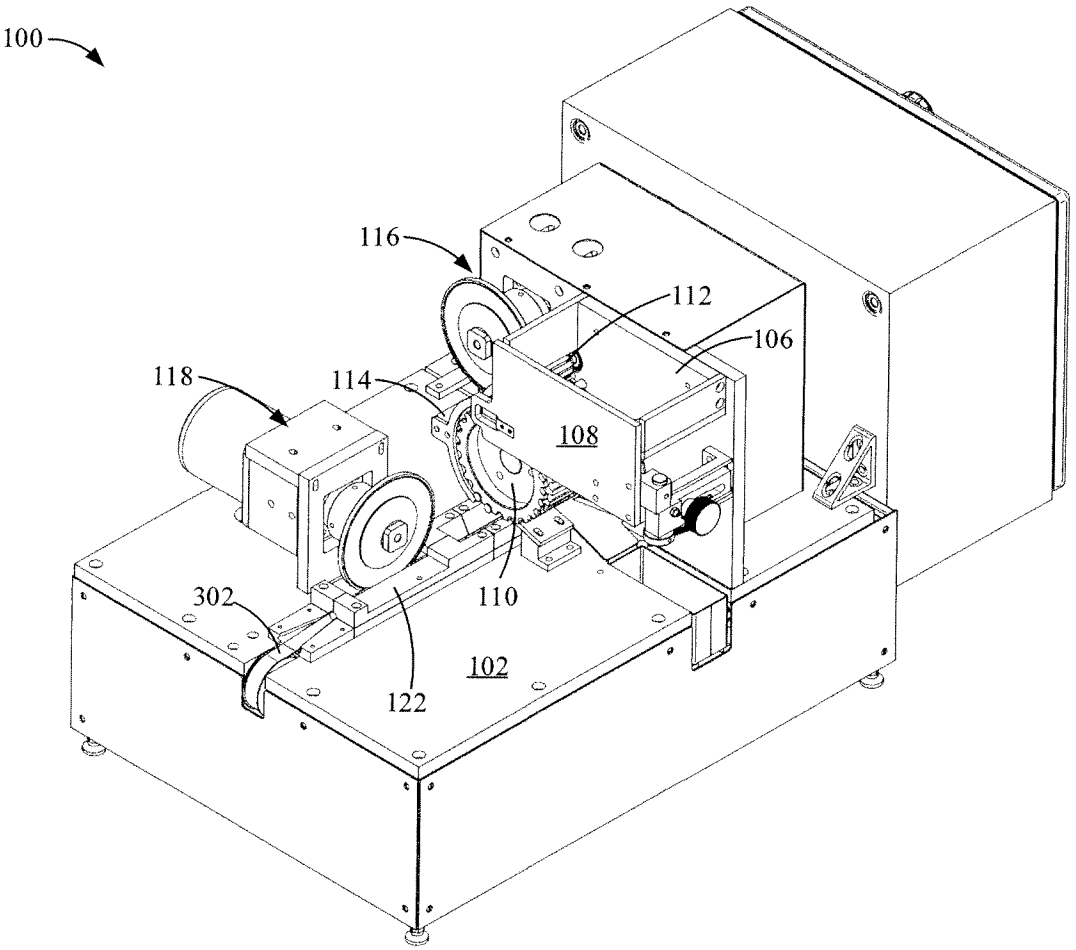
Figure 2:
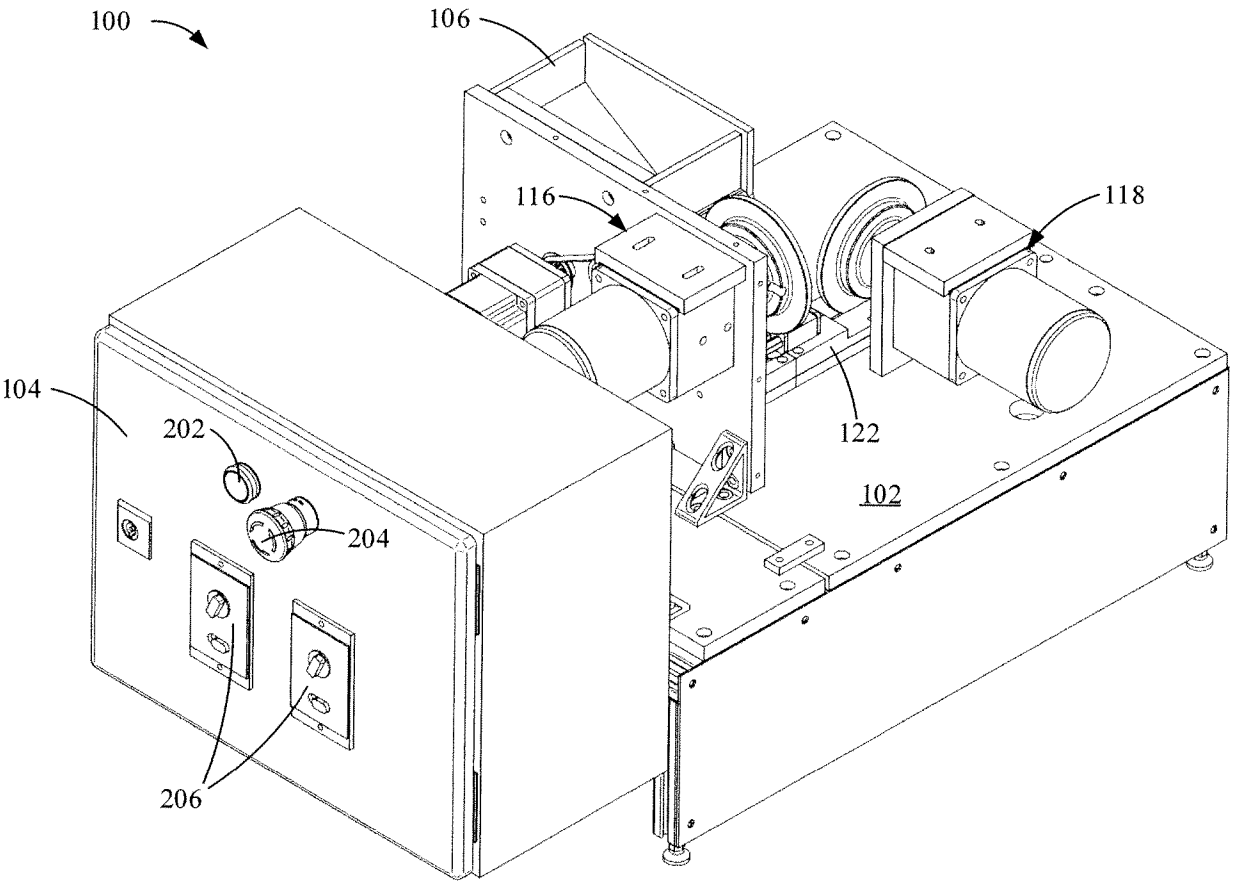
Figure 3:
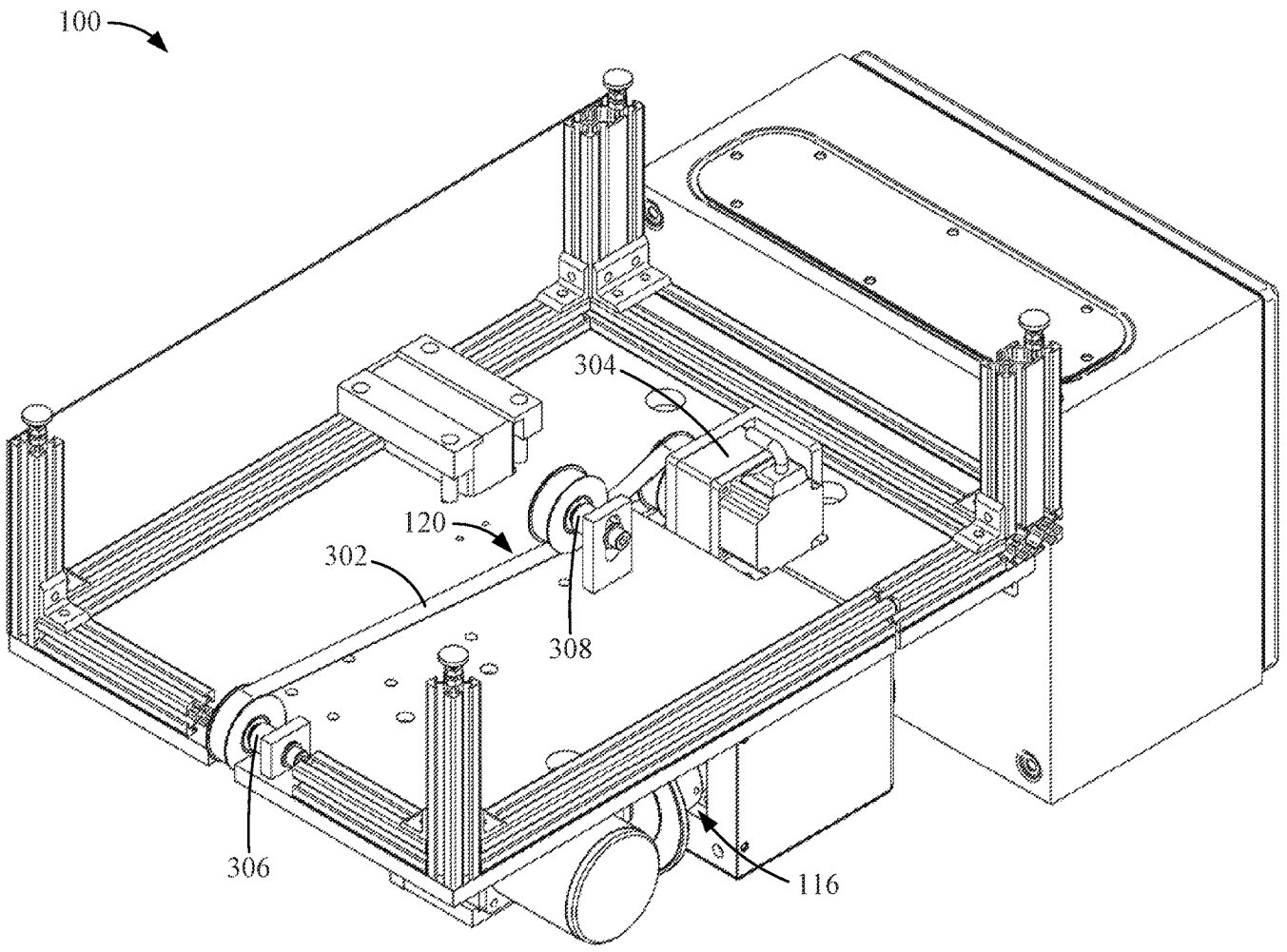
Figure 4A:
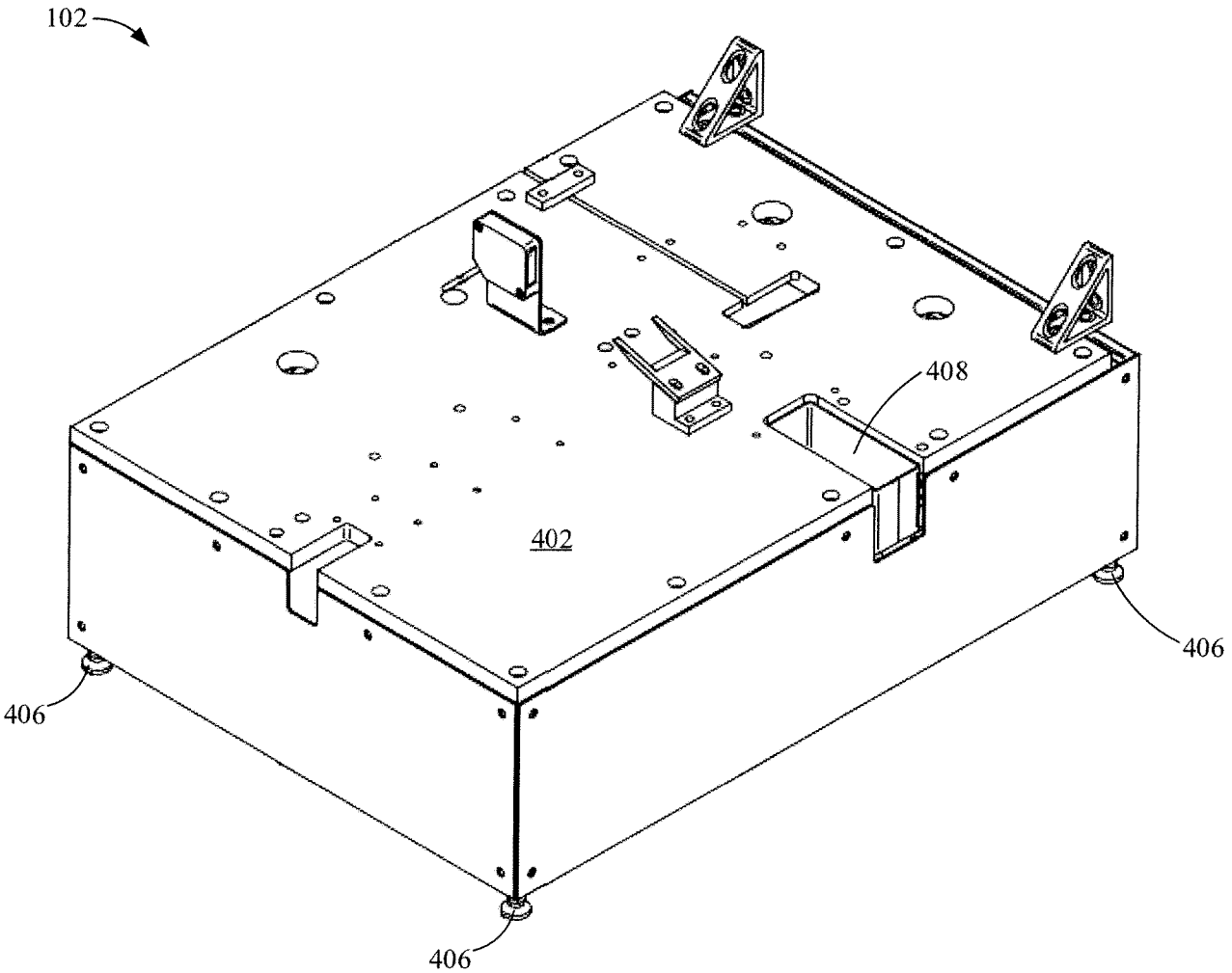
Figure 4B:
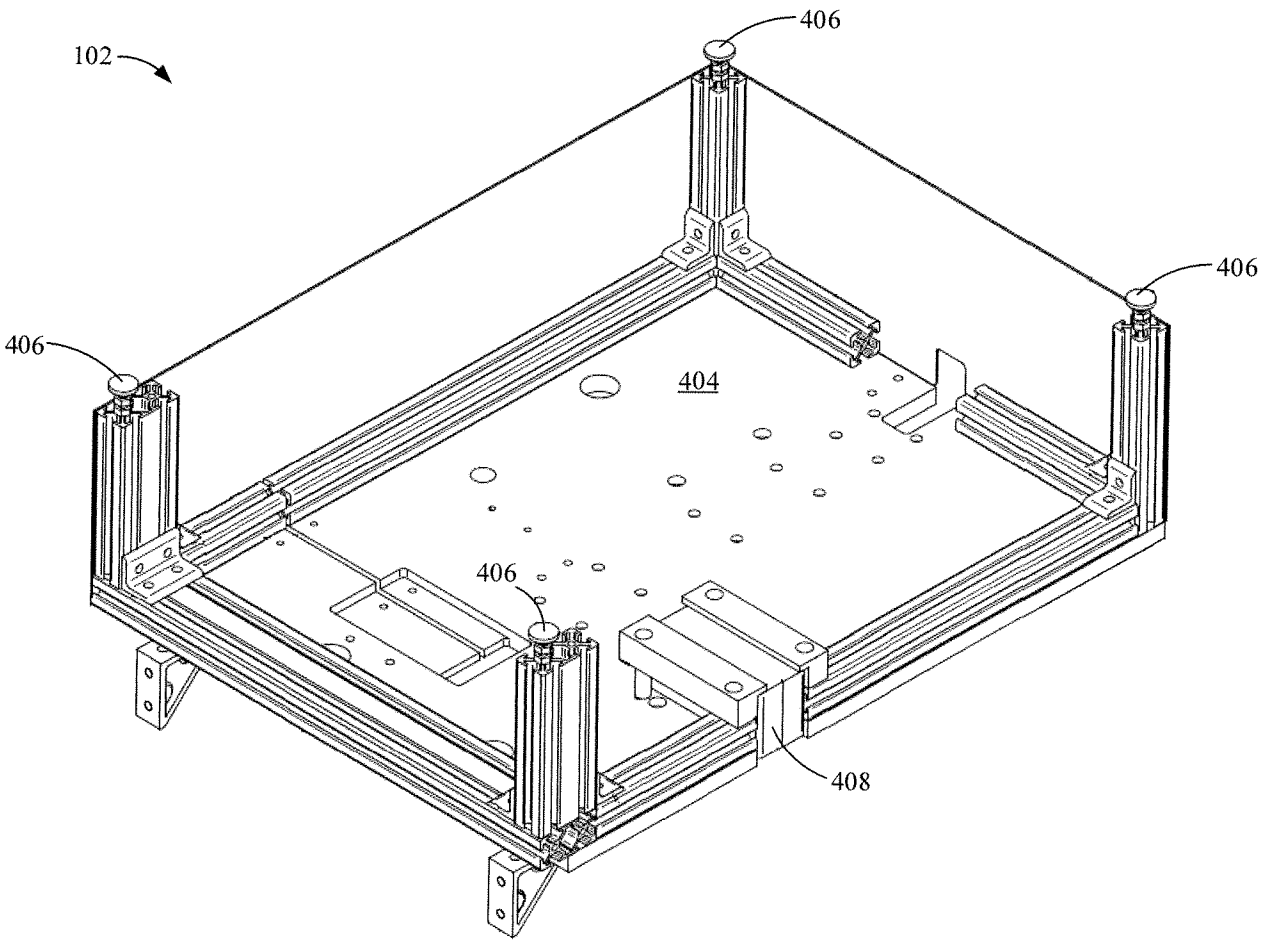
Figure 7A:
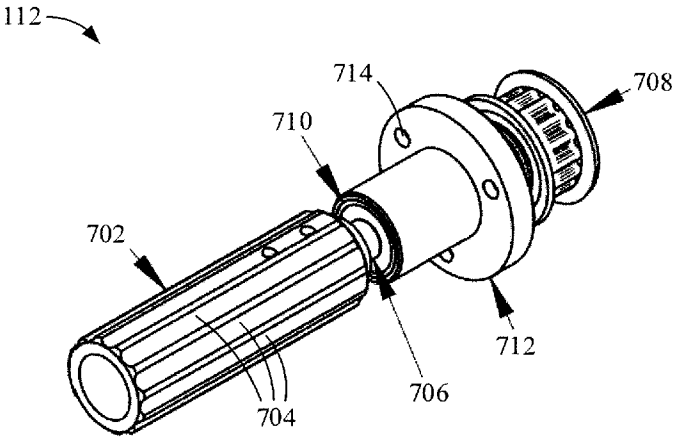
Figure 7C:
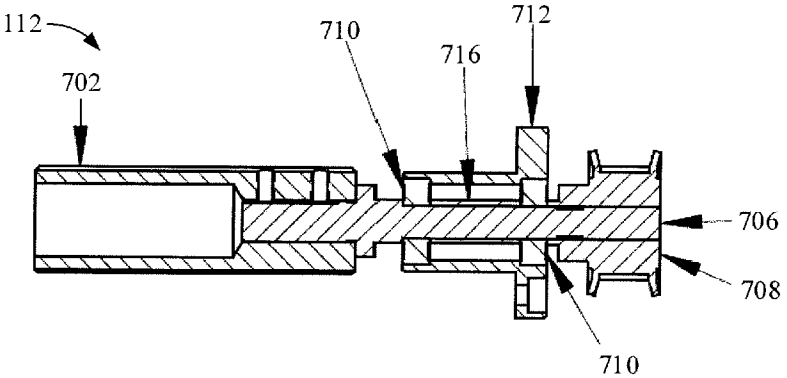
Figure 7B:
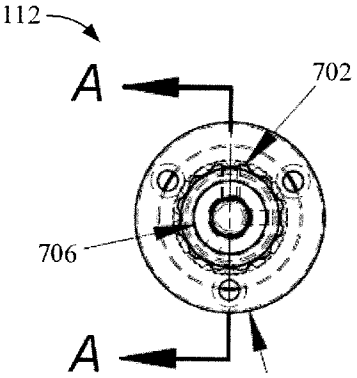
Figure 8B:
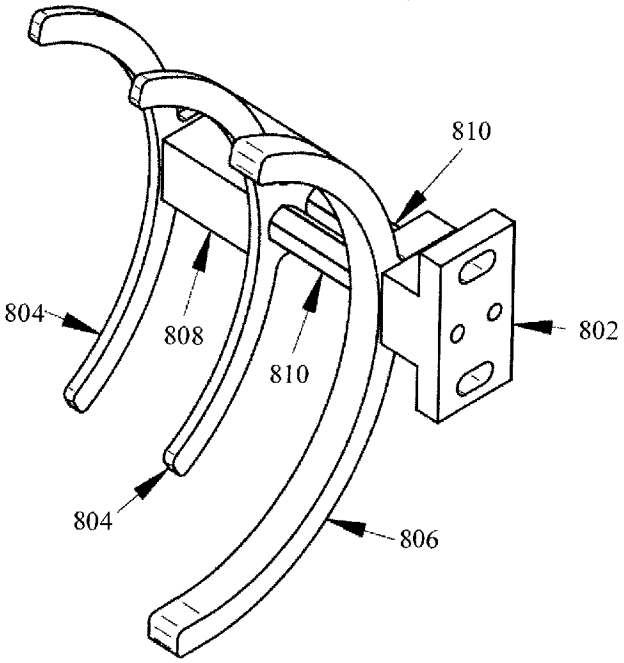
Figure 8A:
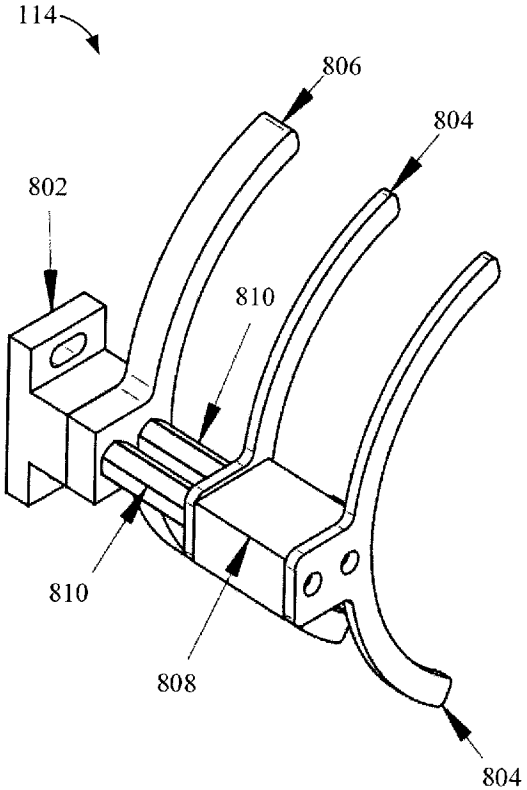
Figure 9A:
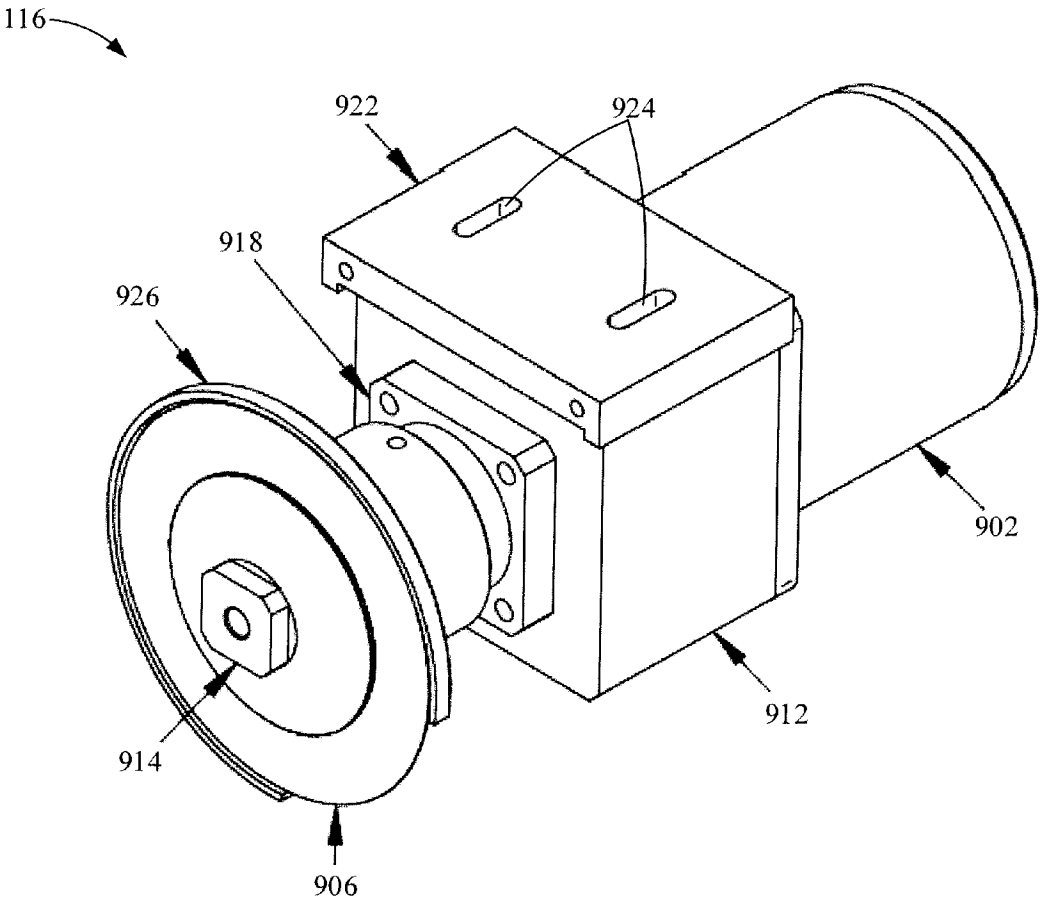
Figure 9C:
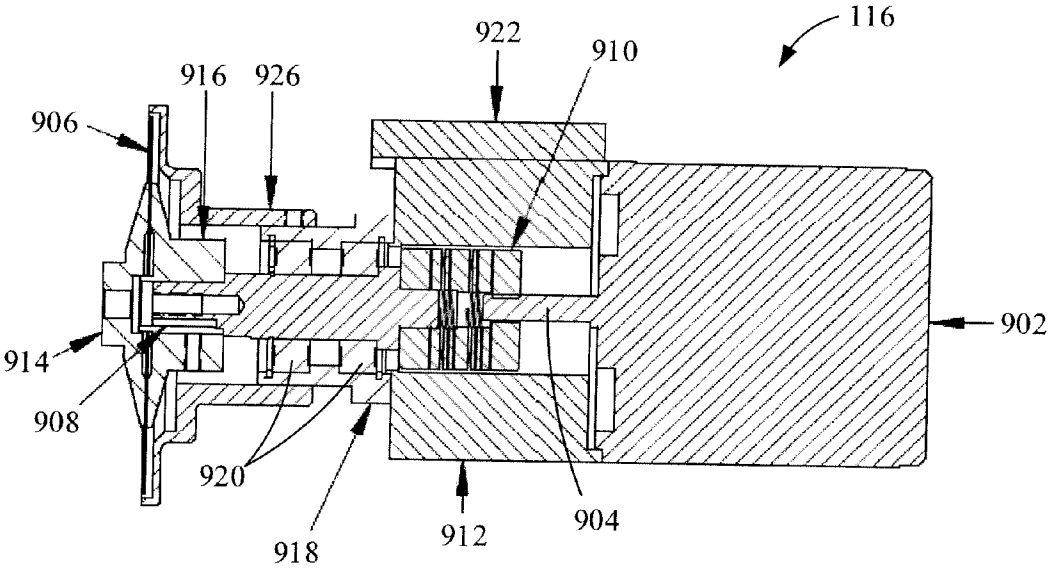
Figure 9B:
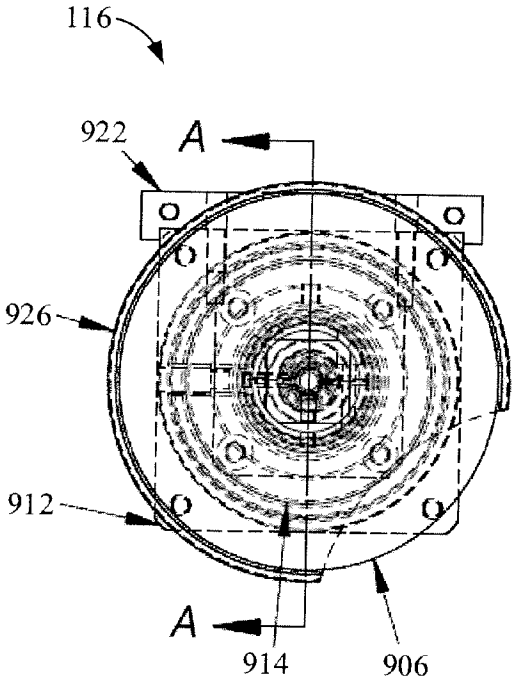
Figure 10B:
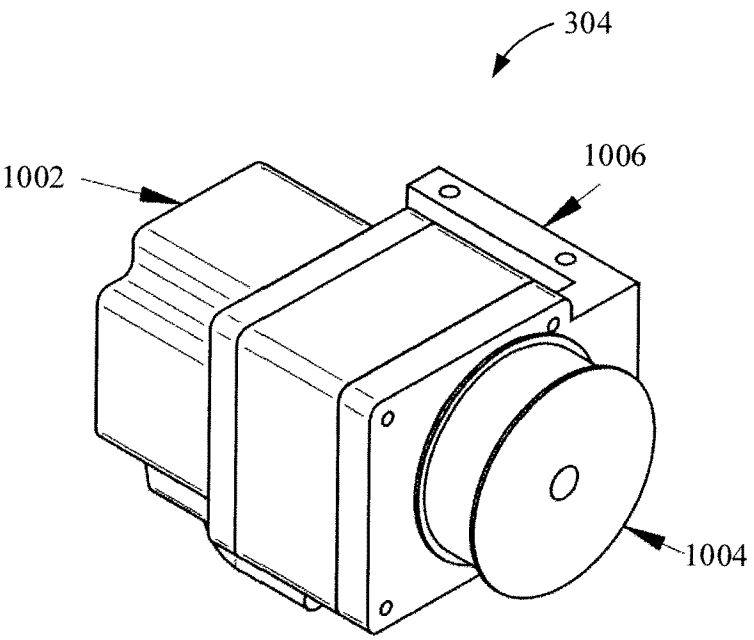
Figure 10A:
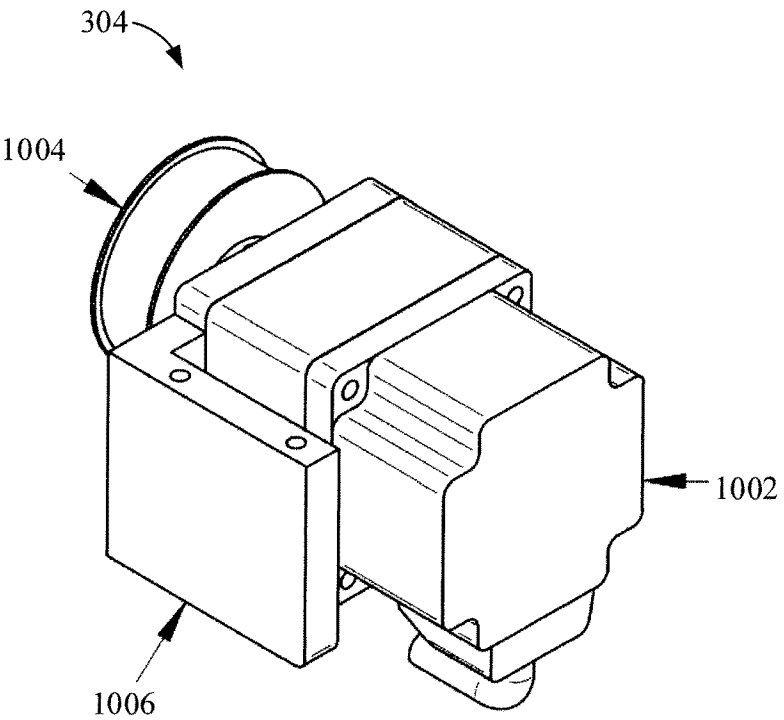
Figure 12:
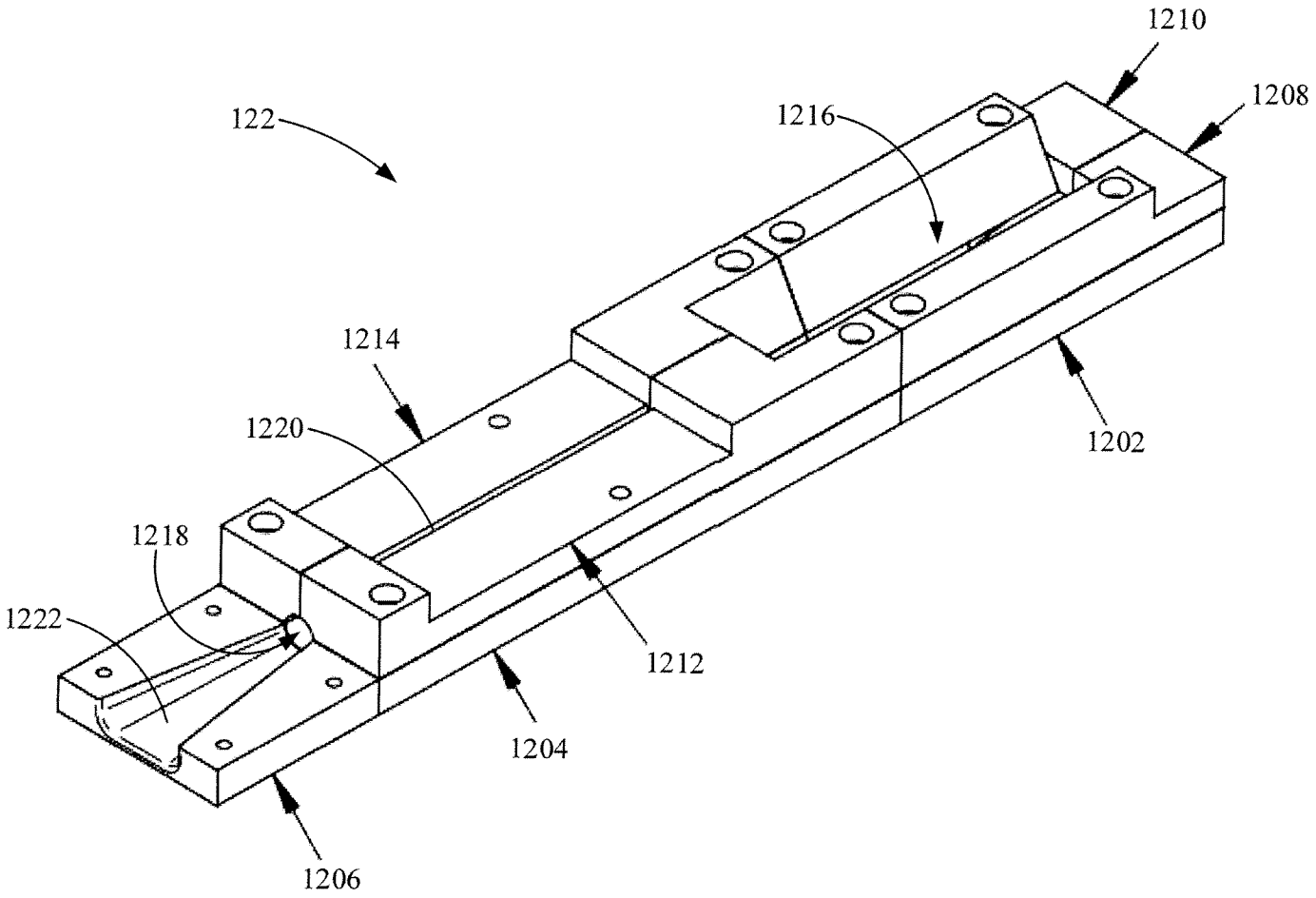
Figure 13A:
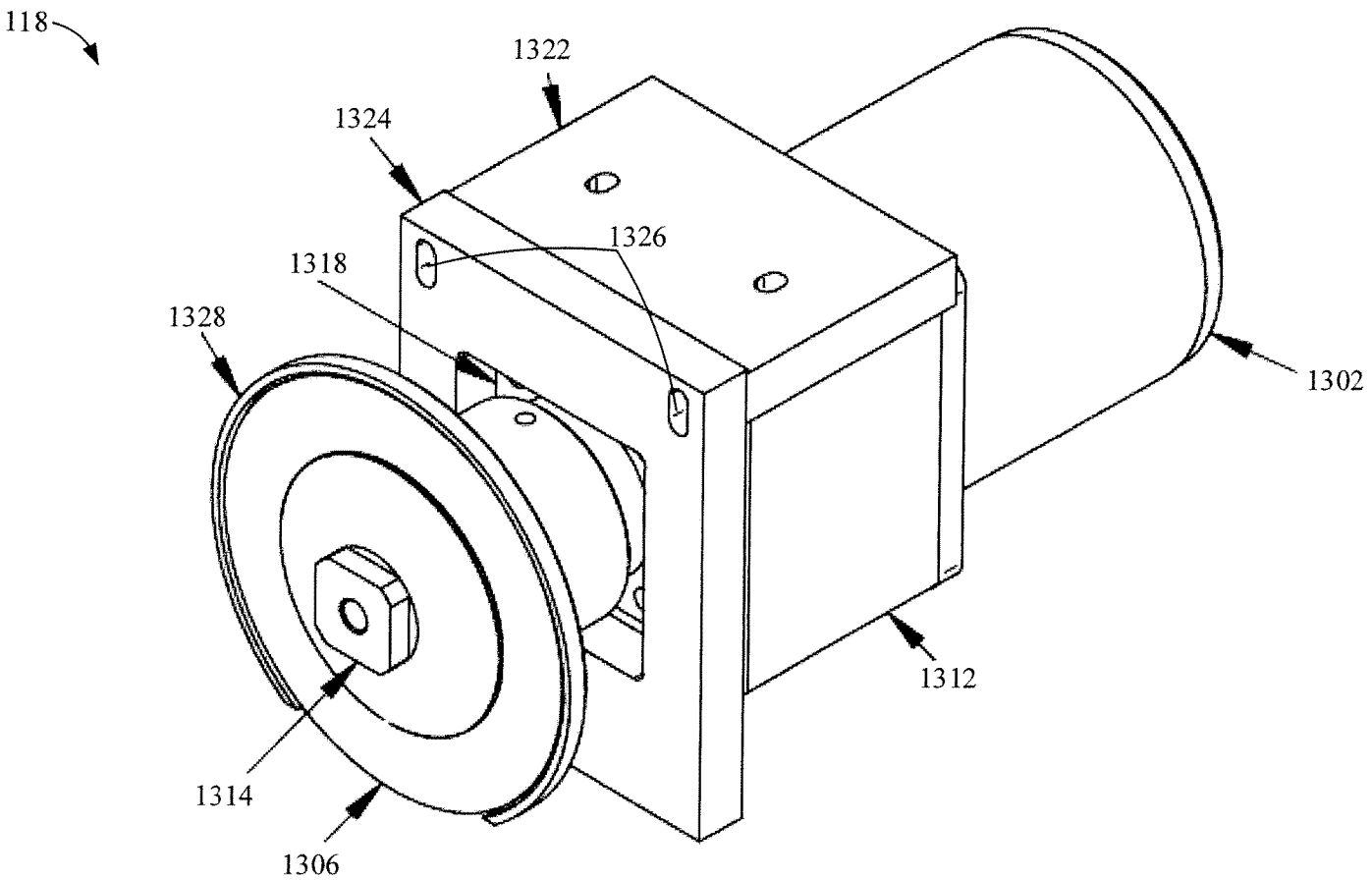
Figure 13C:
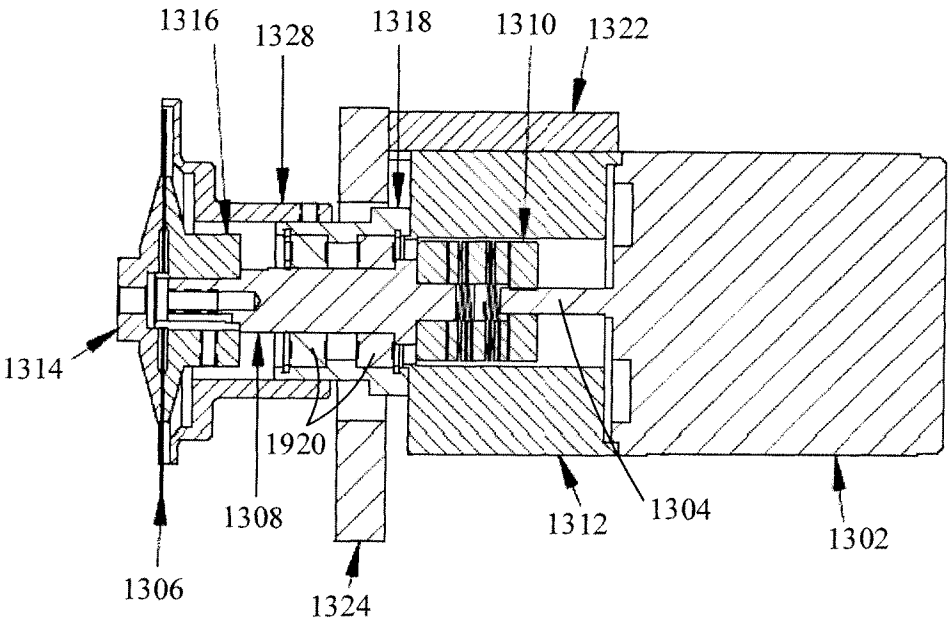
Figure 13B:
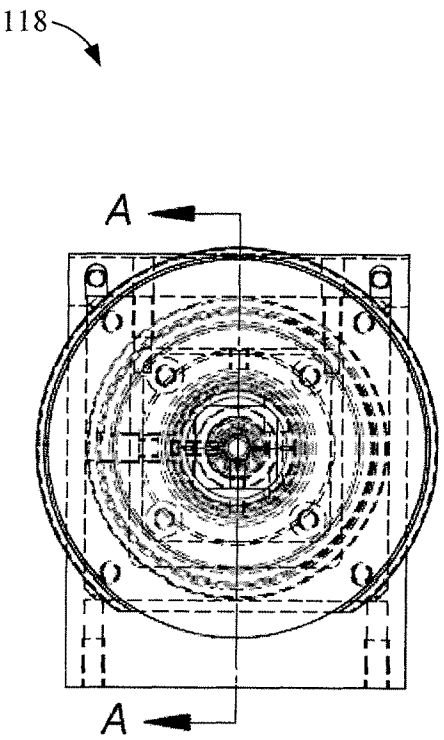
Figure 14:
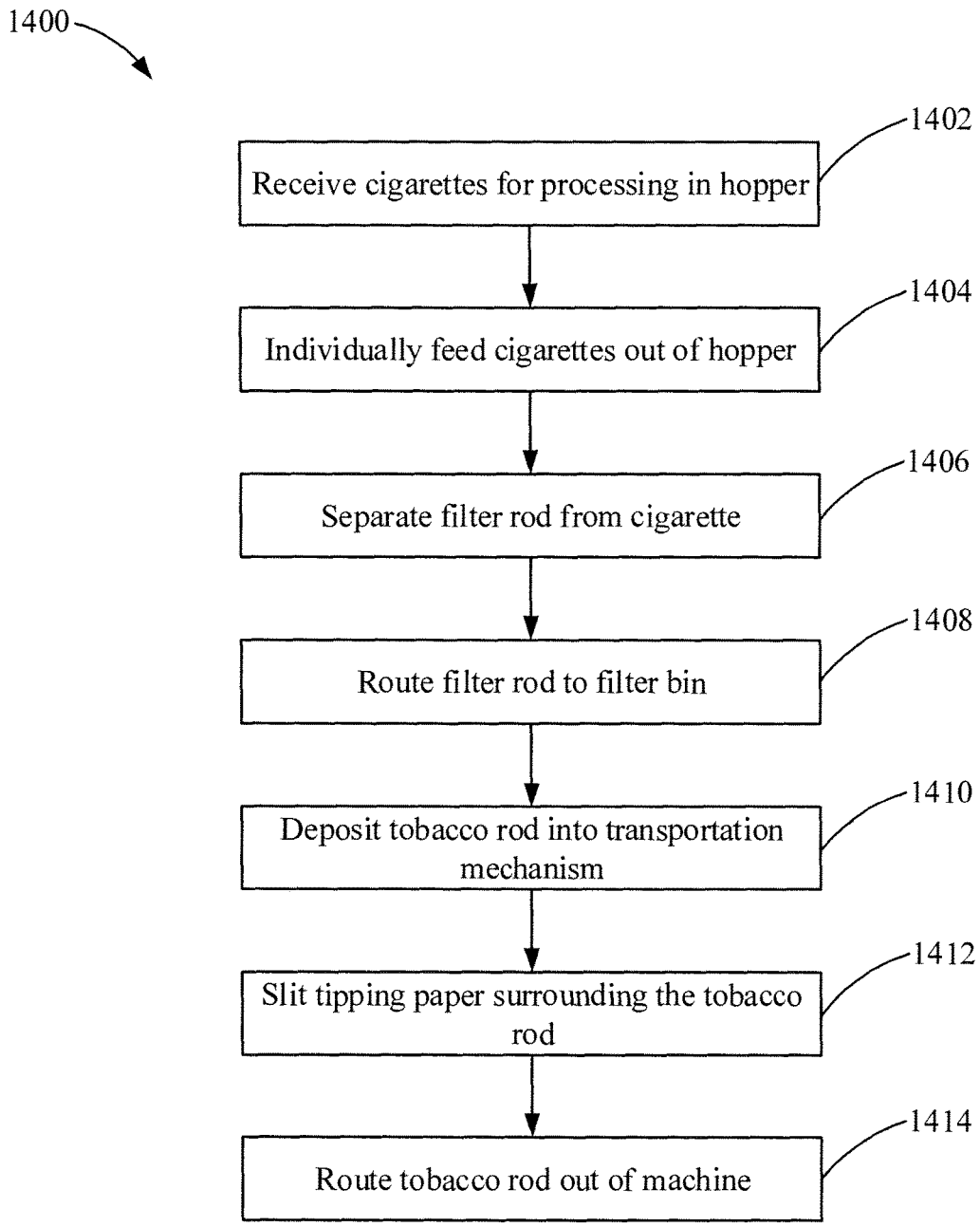

Having thus described the disclosure in general terms, reference will now be made to the accompanying drawings, which are not necessarily drawn to scale, and wherein:

FIG. 1 is a front perspective view of a tobacco recovery machine according to an example embodiment;

FIG. 2 is a rear perspective view of the tobacco recovery machine of FIG. 1;

FIG. 3 is a bottom perspective view of the tobacco recovery machine of FIG. 1;

FIGS. 4A and 4B are perspectives views of the base of the tobacco recovery machine of FIG. 1;

FIGS. 5A through 5D are perspectives views of the components of the hopper of the of the tobacco recovery machine of FIG. 1;

FIGS. 6A through 6D are detailed views of the feed drum of the tobacco recovery machine of FIG. 1;

FIGS. 7A through 7C are detailed views of the refuser roller of the tobacco recovery machine of FIG. 1;

FIGS. 8A and 8B are perspective views of the guide assembly of the tobacco recovery machine of FIG. 1;

FIGS. 9A through 9C are detailed views of the chopping mechanism of the tobacco recovery machine of FIG. 1;

FIGS. 10A and 10B are perspective views of the belt motor assembly of the tobacco recovery machine of FIG. 1;

FIGS. 11A through 11D are perspective views of the pulleys of the tobacco recovery machine of FIG. 1;

FIG. 12 is a perspective view of the guide rail of the tobacco recovery machine of FIG. 1;

FIGS. 13A through 13C are detailed views of the slitting mechanism of the tobacco recovery machine of FIG. 1; and FIG. 14 is a flow diagram of a method of separating the tobacco product from a cigarette through the tobacco recovery machine of FIG. 1 is shown according to an example embodiment.

DETAILED DESCRIPTION OF THE DISCLOSURE

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will be thorough and complete, will fully convey the scope of the disclosure to those skilled in the art, and will satisfy applicable legal requirements. Like numbers refer to like elements throughout. As used in this specification and the claims, the singular forms "a," "an," and "the" include plural referents unless the context clearly dictates otherwise.

Cigarette Tobacco Recovery Machine

Various embodiments described herein relate to a tobacco recovery machine that both automatically removes and separates a tobacco rod from formed cigarettes and slits the tipping paper surrounding the tobacco rod such that the tobacco product forming the tobacco rod can be reused or otherwise disposed of. The cigarettes include a filter rod and tobacco rod having tobacco product wrapped in paper. The tobacco recovery machine includes a hopper that receives cigarettes. A feed mechanism individually feeds the cigarettes from the hopper and through a chopping mechanism that removes the filter rod from each cigarette leaving the cylindrical tobacco rod wrapped in the tipping paper. The tobacco recovery machine next feeds the tobacco rod of the cigarette through a slitting mechanism that slits the tipping paper wrapping surrounding the tobacco. The slitting mechanism axially slits the tipping paper along the tobacco rod such that the tobacco product can separate from the tipping paper. The tobacco recovery machine then provides the tobacco product and the tipping paper into a receiving bin for further processing. The tobacco recovery machine performs both the separation of the filter rod and the slitting of the tipping paper in a single device, which provides added productivity and efficiencies over manually performing these tasks separately.

Referring to FIGS. 1 through 3, various perspective views of a tobacco recovery machine 100 are shown. The tobacco recovery machine 100 includes a base 102. Perspective views of the base 102 having various components of the tobacco recovery machine 100 removed from the base 102 are shown in FIGS. 4A and 4B. In some arrangements, the base 102 is a table having a top surface 402 and a bottom surface 404. A number of mounting holes extend through the base 102 from the top surface 402 to the bottom surface 404. The mounting holes are sized and shaped to receive fasteners that secure the various components of the tobacco recovery machine 100 to the base 102 (e.g., as shown in FIGS. 1 through 3). In some arrangements, the base 102 includes adjustable feet 406 such that the top surface 402 of the base 102 can be leveled if the adjustable feet 406 are positioned on an uneven or slanted surface. The base 102 additionally includes a filter catch bin 408. As described in further detail below, the filter catch bin 408 receives the separated filter rods from the cigarettes being processed by the tobacco recovery machine 100. The filter catch bin 408 is removable from the base 102 such that the collected filters can be easily discarded.

Referring again to FIGS. 1 through 3, the tobacco recovery machine 100 includes a control panel 104 mounted to the base 102. As shown best in FIG. 2, the control panel 104 includes various operator controls (e.g., buttons, switches, knobs, etc.) that allow an operator to power on the tobacco recovery machine 100, to shut power off to the tobacco recovery machine 100, and to control the operation of the tobacco recovery machine 100. The control panel 104 includes a power switch 202 (e.g., a push button), an emergency shut-off button 204, and two sets of motor speed controls 206 (i.e., one set for controlling the chopping mechanism 116 motor 902, and the other set for controlling the slitting mechanism 118 motor 1302). Accordingly, the operator can control both the separation of the filter rod from the tobacco rod and the slitting of the tipping paper surrounding the tobacco rod from a single control panel 104. In some embodiments, the control panel 104 includes another set of motor speed controls to control the motor 1002 of the belt motor assembly 304. In further embodiments, the control panel 104 includes a further set of motor speed controls to control the feed motor 512 of the hopper 106.

Figure 5B:
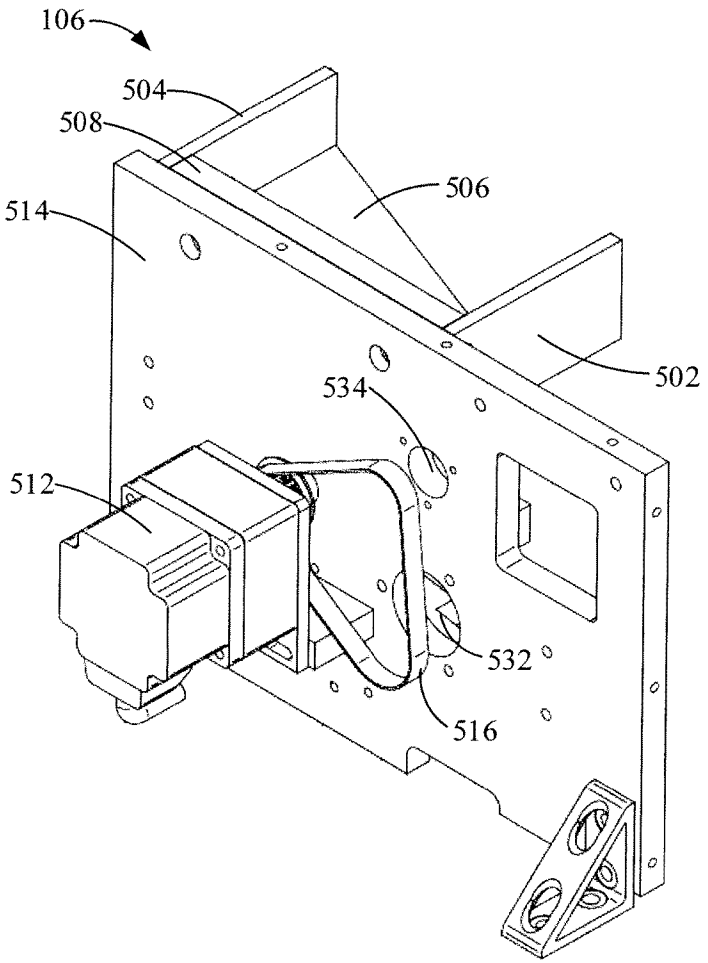
Figure 5A:
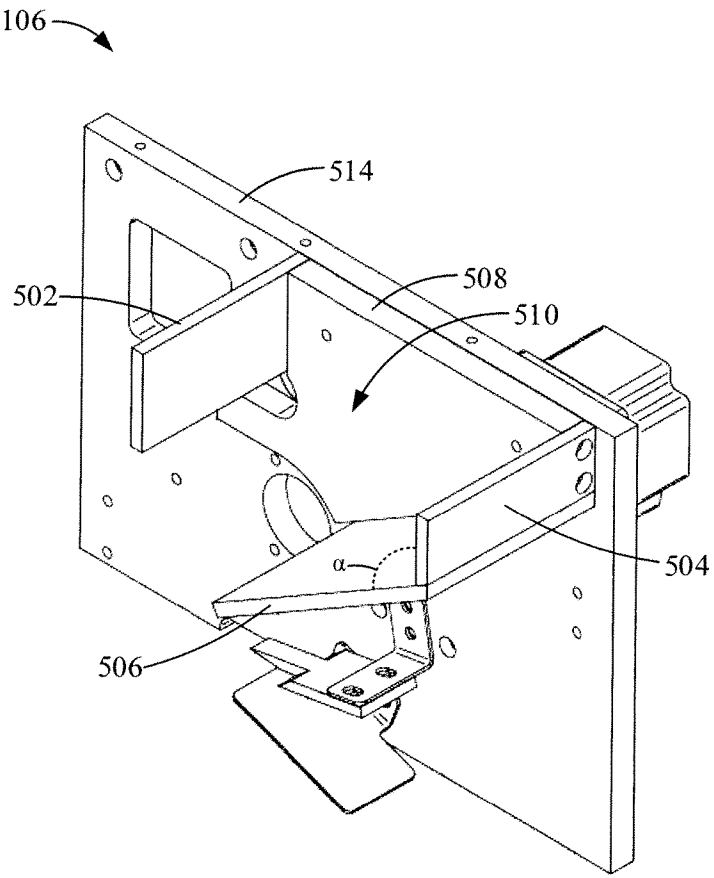
Figure 5D:
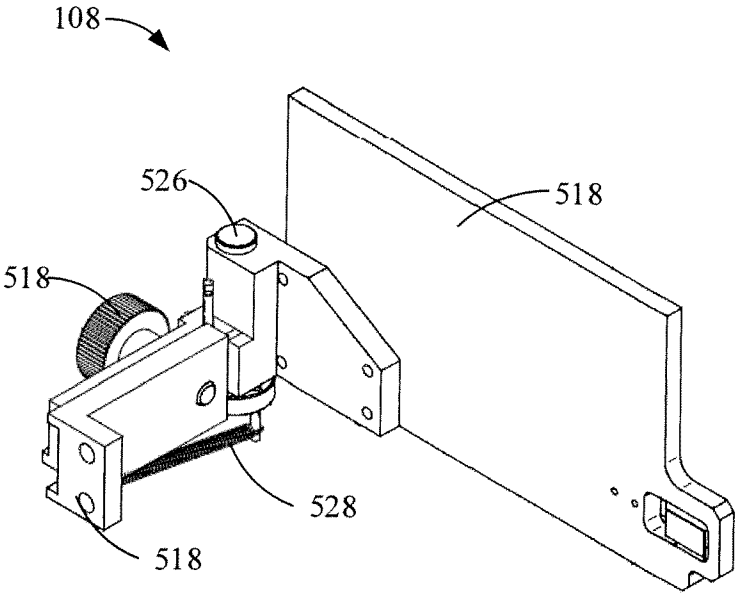
Figure 5C:
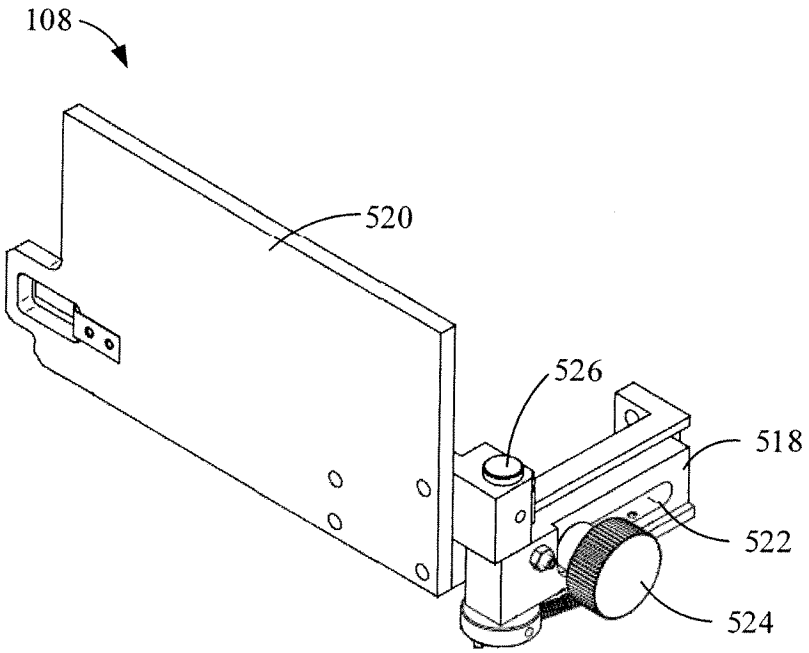

The tobacco recovery machine 100 includes a hopper 106. The hopper 106 receives cigarettes for processing by the tobacco recovery machine 100. The hopper 106 includes a hopper door 108. Detailed views of the hopper 106 are shown in FIGS. 5A and 5B, and detailed views of the hopper door 108 are shown in FIGS. 5C and 5D. As shown in FIG. 5A, the hopper 106 includes a first side plate 502, a second side plate 504, a bottom plate 506, and a back plate 508. The first side plate 502, the second side plate 504, the bottom plate 506, and the back plate 508 form a receiving compartment 510. The receiving compartment 510 holds cigarettes for processing by the tobacco recovery machine 100. The bottom plate 506 is sloped with respect to the second plate 504 such that an obtuse angle $\alpha$ exists between the bottom plate 506 and the second plate 504. The slope of the bottom plate 506 with respect to the second plate 504 guides cigarettes positioned within the receiving compartment 510 towards the feed drum 110 and refuser roller 112 (as shown in FIG. 1) as the cigarettes are moved by gravity. Accordingly, the hopper is a gravity-assisted hopper. The feed drum 110 and the refuser roller 112 are positioned at the opening between opening between the bottom plate 506 and the first side plate 502.

Referring to FIG. 5B, the hopper 106 includes a feed motor 512. The feed motor 512 is coupled to a main wall 514 of the hopper 106. In some arrangements, the feed motor 512 is a brushless direct current ("DC") motor, although other motors may be used. The feed motor 512 drives a timing belt 516. The timing belt 516 in turn drives the feed drum 110 and the refuser roller 112.

As discussed above, the hopper 106 includes a hopper door 108. The hopper door 108 is removably positioned with respect to the hopper 106. The hopper door 108 includes a hopper base 518 that is secured to the base 102 of the tobacco recovery machine 100 (e.g., as shown in FIG. 1). A door wall 520 is attached to the hopper base 518 such that the door wall can axially slide along the hopper base 518 via the slot 522 of the hopper base 518. A knob 524 can be tightened to lock the positioning of the door wall 520 with respect to the slot 522 or loosened to allow for adjustment of the door wall 520 along the slot 522. Additionally, the door wall 520 can rotate with respect to the hopper base 518 via the hinge 526. As shown in FIGS. 1, 5C, and 5D, the door wall 520 is in a closed position. While in the closed position, the door wall 520 closes off the receiving compartment 510 formed by the first side plate 502, the second side plate 504, the bottom plate 506, and the back plate 508 of the hopper 106. While in the closed position, the door wall 520 is adjustable with respect to the back plate 508 of the hopper 106 such that a width of the receiving compartment 510 is adjustable to account for varying axial lengths of different types of cigarettes. When the door wall 520 pivots about the hinge 526 away from the back plate 508, the receiving compartment 510 is opened and the hopper door 108 is in the opened position. While in the opened position, cigarettes and debris (e.g., tobacco product that fell out of previously loaded cigarettes) can be manually cleared from the receiving compartment 510. A spring 528 biases the door wall 520 into the closed position.

Referring again to FIG. 1, the tobacco recovery machine 100 includes a feeding mechanism that individually removes cigarettes from the hopper 106 for processing by the tobacco recovery machine 100. The feeding mechanism includes a feed drum 110, a refuser roller 112, and a guide assembly 114. The feed drum 110 is described in further detail below with respect to FIGS. 6A through 6*d*; the refuser roller 112 is described in further detail below with respect to FIGS. 7A through 7C; and the guide assembly 114 is described in further detail below with respect to FIGS. 8A and 8B.

The feed drum 110 includes a drum body 602. The drum body 602 is substantially cylindrical and includes a first plurality of grooves 604 that extend axially across the outer surface of the drum body 602 and a second plurality of grooves 606 that extend radially around the outer surface of the drum body 602. The first plurality of grooves 604 are each sized and shaped to receive a cigarette (e.g., from the hopper 106). The second plurality of grooves 606 provide clearance for a knife 906 of the filter chopping mechanism 116 such that the knife 906 extends into one of the second plurality of grooves 606 (e.g., as described in further detail below with respect to FIGS. 9A through 9C). The drum body 602 is secured to a first end of a central shaft 608 such that the drum body 602 is rotationally locked to the central shaft 608 (e.g., via press fitting, via an adhesive, via welding, via a fastener, via a locking key and slot arrangement, etc.). Accordingly, as the central shaft 608 rotates, the drum body 602 rotates. Similarly, a timing belt pulley 610 is secured to a second end of the central shaft 608 such that the central shaft 608 rotates when the timing belt pulley 610 rotates. The second end of the central shaft 608 is opposite of the first end of the central shaft 608.

Figure 6B:
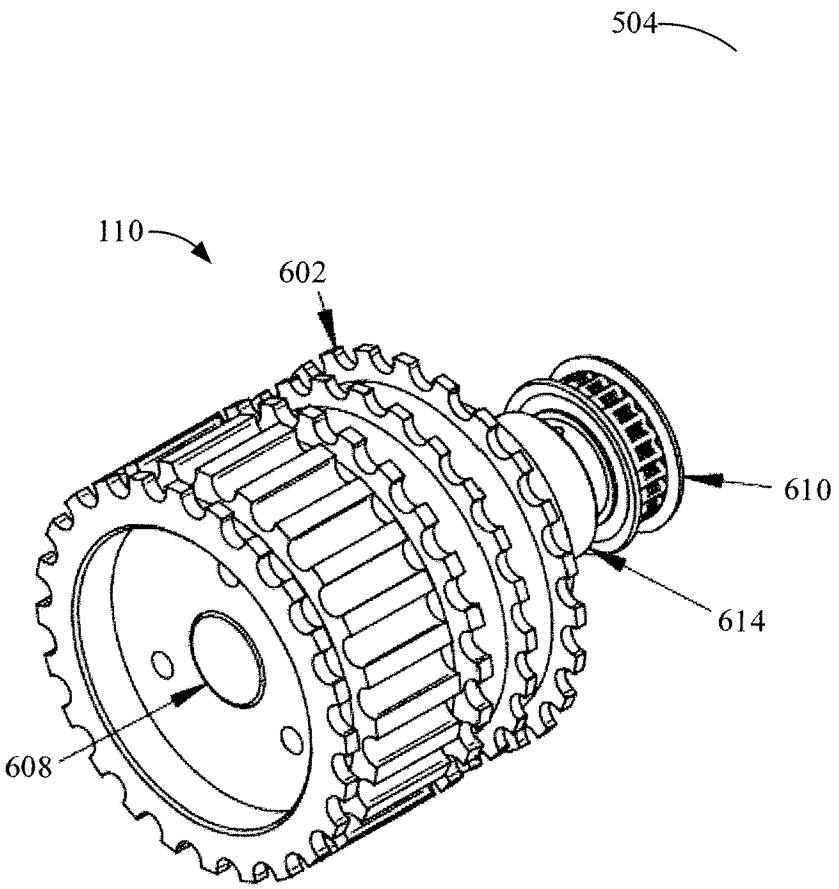
Figure 6A:
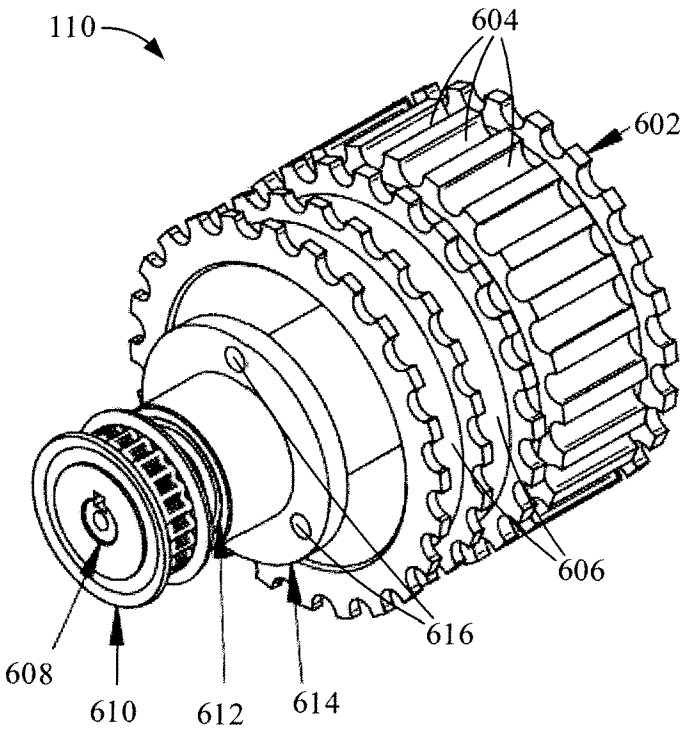
Figure 6D:
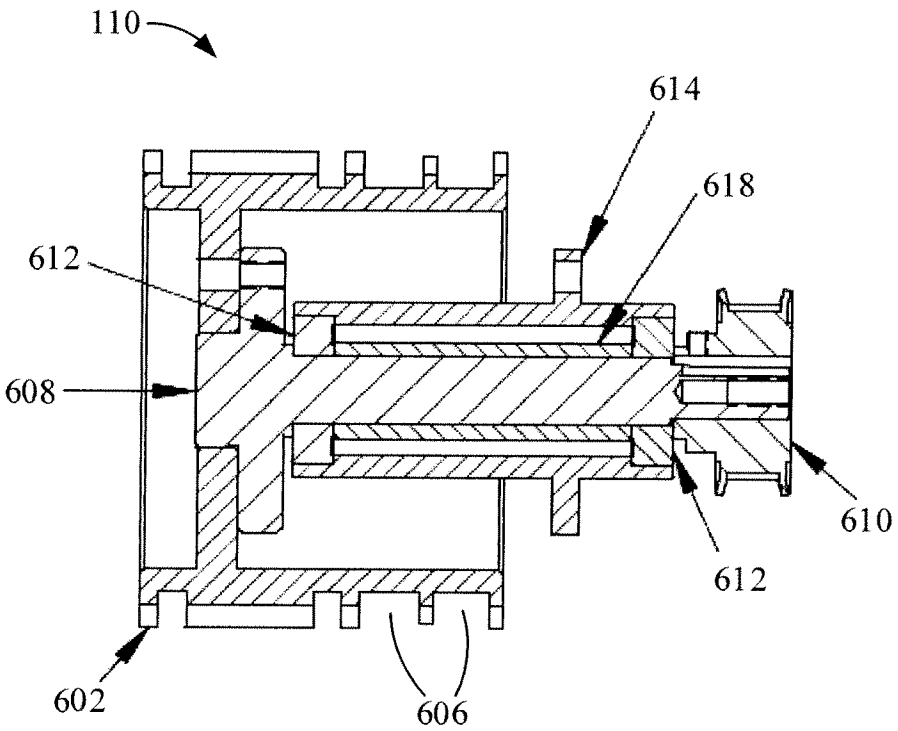
Figure 6C:
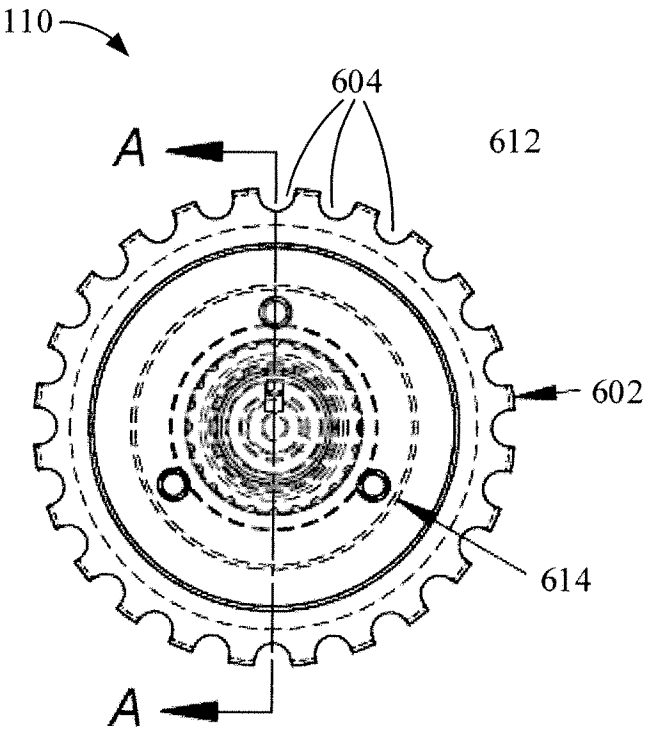

Two bearings 612 are mounted on the central shaft 608 between the first end and the second end. The bearings 612 include a bearing housing 614. The bearing housing 614 includes through holes 616 that receive fasteners used to connect the feed drum 110 to the hopper 106. When the feed drum 110 is connected to the hopper 106, the central shaft 608 extends through the opening 532 in the main wall 514 such that the timing belt pulley 610 mates with the timing belt 516. The bearings 612 allow the central shaft 604 to rotate with respect to the bearing housing 614, which remains rotationally fixed with respect to the main wall 514. Details of the bearings 612 are shown in FIG. 6D, which is a cross-sectional view of the feed drum taken along line A-A of FIG. 6C. The bearings 612 are separated along an axial distance of the central shaft 608 by a bearing spacer 618.

As shown in FIGS. 7A through 7C, the refuser roller 112 is similar to the feed drum 110. The refuser roller 112 includes a roller body 702. The roller body 702 is substantially cylindrical and includes a plurality of grooves 704 that extend axially across the outer surface of the drum body 702. The plurality of grooves 704 are sized and shaped to agitate a cigarette (e.g., from the hopper 106). The plurality of grooves 704 cooperate with the first plurality of grooves 604 of the feed drum 110 to individually dispense cigarettes from the hopper 106. The roller body 702 is secured to a first end of a central shaft 706 such that the roller body 702 is rotationally locked to the central shaft 706 (e.g., via press fitting, via an adhesive, via welding, via a fastener, via a locking key and slot arrangement, via set screws, etc.). Accordingly, as the central shaft 706 rotates, the roller body 702 rotates. Similarly, a timing belt pulley 708 is secured to a second end of the central shaft 706 such that the central shaft 706 rotates when the timing belt pulley 708 rotates. The second end of the central shaft 706 is opposite of the first end of the central shaft 706.

Two bearings 710 are mounted on the central shaft 706 between the first end and the second end. The bearings 710 include a bearing housing 712. The bearing housing 712 includes through holes 714 that receive fasteners used to connect the refuser roller 112 to the hopper 106. When the refuser roller 112 is connected to the hopper 106, the central shaft 706 extends through the opening 534 in the main wall 514 such that the timing belt pulley 708 mates with the timing belt 516. Accordingly, when the refuser roller 112 is connected to the hopper 106, the refuser roller 112 is adjacent to the feed drum 110 (e.g., as shown in FIG. 1). The bearings 710 allow the central shaft 706 to rotate with respect to the bearing housing 712, which remains rotationally fixed with respect to the main wall 514. Details of the bearings 710 are shown in FIG. 7C, which is a cross-sectional view of the feed drum taken along line A-A of FIG. 7B. The bearings 710 are separated along an axial distance of the central shaft 706 by a bearing spacer 716.

As shown in FIGS. 8A and 8B, the guide assembly 114 includes a mounting block 802, two tobacco rod rails 804, and a filter rod rail 806. The two tobacco rod rails 804 include a first tobacco rod rail and a second tobacco rod rail, the second tobacco rod rail is positioned farther from the mounting block than the first tobacco rod rail along an axial direction (of the feed drum 110). The two tobacco rod rails 804 are adjacent to each other and separated by a distance. A spacer 808 maintains the distance between the two tobacco rod rails 804. The filter rod rail 806 is adjacent to the mounting block 802 and positioned between the mounting block 802 and first tobacco rod rail. The distance between the filter rod rail 806 and the first tobacco rod rail is variable to account for different lengths of cigarettes. The distance between the filter rod rail 806 and the first tobacco rod rail can be increased or decreased by rotating the adjustment rods 810.

The two tobacco rod rails 804 and the filter rod rail 806 are arc shaped having a curvature that allows the guide assembly 114 to partially surround the curved outer surface of the feed drum 110. Accordingly, during operation of the tobacco recovery machine 100, the guide assembly 114 keeps the cigarettes in the first plurality of grooves 604 as the feed drum 110 rotates past the chopping mechanism 116 knife 906. After the filter rod of the cigarette is removed, the filter rod rail 806 routes the separated filter rod into the filter catch bin 408, and the tobacco rod rails 804 guide the tobacco rod of each cigarette into the entrance guide 1216 of the guide rail 122 (e.g., as described in further detail below with respect to FIG. 12).

Referring again to FIGS. 1 through 3, the tobacco recovery machine 100 includes a chopping mechanism 116. The chopping mechanism 116 separates the filter rod from the tobacco rod of each cigarette conveyed by the feed drum 110. The chopping mechanism 116 is shown in detail in FIGS. 9A through 9C. After separation, the filter rod is routed to filter catch bin 408 (e.g., as described above), and the tobacco rod proceeds to the slitting mechanism 118. The chopping mechanism 116 includes a motor 902. In some arrangements, the motor is a DC induction motor. When the motor 902 is powered, the motor 902 turns a spindle 904. The spindle 904 is shown in FIG. 9C, which is a cross-sectional view along line A-A of FIG. 9B. The chopping mechanism 116 includes a knife 906. The knife 906 is a circular blade that is rotationally coupled to the spindle 904 of the motor 902. Accordingly, when the motor 902 is powered, the knife 906 rotates. To transfer rotational motion from the spindle 904 to the knife 906, the knife is rotationally coupled to a shaft 908, which in turn is rotationally coupled to the spindle 904. The shaft 908 is rotationally coupled to the spindle 904 through a coupling device 910. In some arrangements, the coupling device 910 is a helical coupling. The connection between the shaft 908 and the spindle 904 via the coupling device 910 is housed within a motor housing 912.

The knife 906 is connected to the shaft 908 through a first blade holder 914 and a second blade holder 916. The first blade holder 914 is on a first side of the knife 906, and the second blade holder 916 is on a second side of the knife 906. The second side of the knife 906 is opposite the first side of the knife 906 in the axial direction. The second blade holder 916 is rotationally secured to the shaft 908 (e.g., via a press fit, via welding, etc.). The first blade holder 914 is secured to the shaft 908 via a fastener (e.g., a screw). When the fastener is tightened, the knife 906 is pressed between the first blade holder 914 and the second blade holder 916 such that the knife 906 rotates when the shaft 908 rotates.

As shown best in FIG. 9C, the shaft 908 is cantilevered out from the motor housing 912. The chopping mechanism 116 includes a double bearing assembly 918 to help stabilize the shaft 908 against radial loads experienced during cutting operations. The double bearing assembly 918 is secured to the motor housing 912. The double bearing assembly 918 includes two bearings 920 that radially stabilize the shaft 908 with respect to the motor housing 912 while allowing the shaft 908 to rotate with respect to the motor housing 912.

The chopping mechanism 116 is attached to the tobacco recovery machine 100 through a mounting bracket 922. The mounting bracket includes two elongated mounting slots 924 that receive fasteners. The elongated shape of the mounting slots 924 allows the chopping mechanism 116 to be adjusted in an axial direction with respect to the common axis of the spindle 904 and the shaft 908. The adjustment allows for positioning of the knife 906 within one of the second plurality of grooves 606 of the feed drum such that the knife 906 removes the filter rod of a cigarette with minimal tobacco loss. Further, the elongated mounting slots 924 allow the chopping mechanism 116 to be adjusted for proper removal of different sized filter rods of different types of cigarettes.

The chopping mechanism 116 includes a blade shield 926. The blade shield covers a first portion of the cutting edge of the knife 906 such that only a second portion of the cutting edge is exposed. The blade shield 926 is secured to the chopping mechanism 116 via the double bearing assembly 918.

Referring again to FIGS. 1 through 3, after the cigarette passes through the chopping mechanism 116, the feed drum 110 deposits the tobacco rod into a transportation mechanism and deposits the filter rod into the filter catch bin 408. The transportation mechanism passes the tobacco rod past a slitting mechanism 118 and out of the tobacco recovery machine 100 (e.g., into a collection bin for further processing). The transportation mechanism is comprised of two primary systems: a belt drive system 120 (as shown best in FIG. 3) and a guide rail 122. The belt drive system 120 is described in further detail below with respect to FIGS. 3, 10A, 10B, and 11A through 11D. The guide rail 122 is described in further detail below with respect to FIG. 12.

The belt drive system 120 in its assembled state is shown best in FIG. 3. As shown in FIG. 3, the belt drive system includes a transportation belt 302, a belt motor assembly 304, an idler pulley 306, and a tensioner pulley 308. The transportation belt 302 is driven by the belt motor assembly 304 and is supported by the idler pulley 306 and the tensioner pulley 308. As shown in FIG. 1, the transportation belt 302 is exposed on the top of the base 102. In some embodiments, the transportation belt 302 runs through the guide rail 122 (e.g., through the channel 1218). In other arrangements, the transportation belt 302 is positioned between the guide rail 122 and the base 102. As the belt motor assembly 304 drives the transportation belt 302, the transportation belt 302 carries tobacco rods from the feed drum 110, through the guide rail 122, past the slitting mechanism, and out of the tobacco recovery machine 100 (e.g. into a collection bin). In some arrangements, the transportation belt 302 is textured (e.g., with an abrasive surface, with grooves, with bumps, with dimples, etc.) to help grip tobacco rods carried on the transportation belt 302.

The belt motor assembly 304 is shown in FIGS. 10A and 10B. The belt motor 304 assembly includes a motor 1002. In some arrangements, the motor 1002 is a brushless DC motor. The motor 1002 rotates a drive pulley 1004. When the drive pulley 1004 is rotated by the motor 1002, the drive pulley 1004 drives the transportation belt 302. The belt motor assembly 304 includes a mounting bracket 1006. The mounting bracket 1006 is used to secure the belt motor assembly 304 to the base 102 as shown in FIG. 3.

Figure 11A:
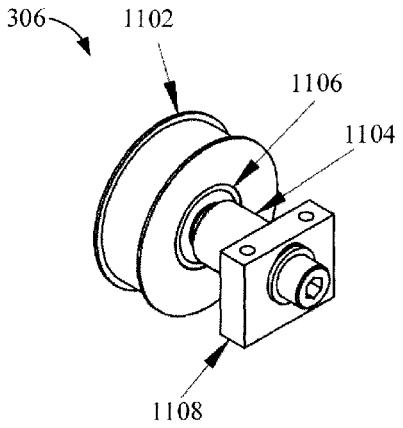
Figure 11B:
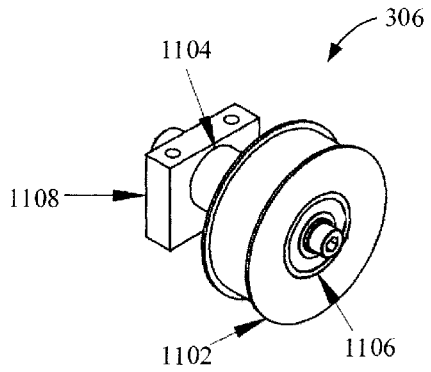
Figure 11C:
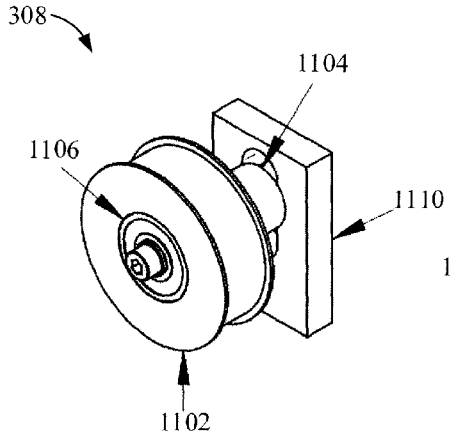
Figure 11D:
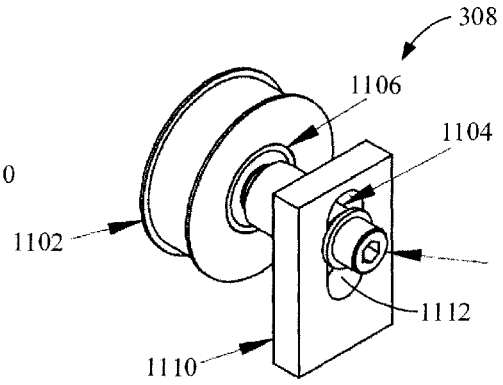

The idler pulley 306 is shown in FIGS. 11A and 11B. The tensioner pulley 308 is shown in FIGS. 11C and 11D. The idler pulley 306 and the tensioner pulley 308 have a similar arrangement of parts. Accordingly, like numbering is used to designate like parts. As described in further detail below, the primary difference between the idler pulley 306 and the tensioner pulley 308 is that the tensioner pulley 308 is adjustable to maintain the transportation belt 302 in a taut condition. Each of the idler pulley 306 and the tensioner pulley 308 include a pulley wheel 1102, a shaft 1104, and a bearing 1106 connecting the pulley wheel 1102 to the shaft 1104. The idler pulley 306 includes an idler pulley mount 1108. The idler pulley mount 1108 connects the idler pulley 306 to the base 102 as shown in FIG. 3. Similarly, the tensioner pulley 308 includes a tensioner pulley mount 1110. The tensioner pulley mount 1110 includes an elongated slot 1112. The elongated slot 1112 allows the pulley wheel 1102 of the tensioner pulley 308 to be adjusted along the length of the elongated slot 1112. Accordingly, the tensioner pulley 308 can be adjusted to maintain the transportation belt 302 in a taut condition. In some embodiments, the tensioner pulley 308 is biased by a spring to maintain the transportation belt 302 in the taut condition.

The guide rail 122 keeps the tobacco rod properly aligned with respect to the slitting mechanism 118. The guide rail 122 includes a guide rail body formed by a bottom entrance plate 1202, a bottom slit plate 1204, and an exit plate 1206. The bottom entrance plate 1202, the bottom slit plate 1204, and the exit plate 1206, for the bottom half of the guide rail 122 that is adjacent to the top surface of the base 102. The guide rail 122 includes a first top entrance plate 1208 and a second top entrance plate 1210 positioned over the bottom entrance plate 1202. The guide rail includes a first top slit plate 1212 and a second top slit plate 1214 positioned over the bottom slit plate 1204. The first and second top entrance plates 1208 and 1210 and the first and second top slit plates 1212 and 1214 form an entrance guide 1216. The entrance guide 1216 includes a central opening and two surfaces sloped towards the central opening such that when a tobacco rod falls from the feed drum 110, the tobacco rod is guided through the central opening and into a guide channel 1218 formed within the guide rail 122. The channel 1218 is substantially circular in cross section and is sized and shaped to receive the tobacco rods of the cigarettes. In some embodiments, the bottom entrance plate 1202 and the bottom slit plate 1204 are open adjacent to the base 102 such that the transportation belt 302 is exposed to tobacco rods traveling through the guide rail 122. In other arrangements, the transportation belt 302 is arranged such that it passes in between the bottom entrance plate 1202 and the bottom slit plate 1204 and the top plates 1208 through 1214.

The first and second top slit plates 1212 and 1214 form a knife opening 1220. The knife opening 1220 allows the knife 1306 of the slitting mechanism 118 to pass through the first and second top slit plates 1212 and 1214 and into the channel 1218 to slit the paper surrounding the tobacco rods passing through the channel 1218.

In some arrangements, the guide rail 122 includes a vibrator. The vibrator vibrates the guide rail 122, and thus vibrates the tobacco rod and tipping paper as the tobacco rod travels through the channel 1218. After the tipping paper is slit, the vibrations help separate the tobacco product within the tobacco rod from the tipping paper.

Referring to FIGS. 13A through 13C, the slitting mechanism 118 is described in further detail. The slitting mechanism 118 is substantially similar to the chopping mechanism 116. As described above, the slitting mechanism 118 slits the paper surrounding the tobacco rod along an axial direction of the substantially cylindrical tobacco rod. The slitting mechanism 118 includes a motor 1302. In some arrangements, the motor 1302 is a DC induction motor. When the motor 1302 is powered, the motor 1302 turns a spindle 1304. The spindle 1304 is shown in FIG. 13C, which is a cross-sectional view along line A-A of FIG. 13B. The slitting mechanism 118 includes a knife 1306. The knife 1306 is a circular blade that is rotationally coupled to the spindle 1304 of the motor 1302. Accordingly, when the motor 1302 is powered, the knife 1306 rotates. To transfer rotational motion from the spindle 1304 to the knife 1306, the knife is rotationally coupled to a shaft 1308, which in turn is rotationally coupled to the spindle 1304. The shaft 1308 is rotationally coupled to the spindle 1304 through a coupling device 1310. In some arrangements, the coupling device 1310 is a helical coupling. The connection between the shaft 1308 and the spindle 1304 via the coupling device 1310 is housed within a motor housing 1312.

The knife 1306 is connected to the shaft 1308 through a first blade holder 1314 and a second blade holder 1316. The first blade holder 1314 is on a first side of the knife 1306, and the second blade holder 1316 is on a second side of the knife 1306. The second side of the knife 1306 is opposite the first side of the knife 1306 in the axial direction. The second blade holder 1316 is rotationally secured to the shaft 1308 (e.g., via a press fit, via welding, etc.). The first blade holder 1314 is secured to the shaft 1308 via a fastener (e.g., a screw). When the fastener is tightened, the knife 1306 is pressed between the first blade holder 1314 and the second blade holder 1316 such that the knife 1306 rotates when the shaft 1308 rotates.

As shown best in FIG. 13C, the shaft 1308 is cantilevered out from the motor housing 1312. The slitting mechanism 118 includes a double bearing assembly 1318 to help stabilize the shaft 1308 against radial loads experienced during cutting operations. The double bearing assembly 1318 is secured to the motor housing 1312. Similar to the double bearing 918 of the chopping mechanism 116, the double bearing assembly 1318 of the slitting mechanism 118 includes two bearings 1320 that radially stabilize the shaft 1308 with respect to the motor housing 1312 while allowing the shaft 1308 to rotate with respect to the motor housing 1312.

The slitting mechanism 118 is attached to the tobacco recovery machine 100 through a mounting bracket formed by a top bracket 1322 and a front bracket 1324. The top bracket 1322 connects with the front bracket 1324 with a pair of fasteners that extend through the elongated holes 1326 of the front bracket 1324. The elongated holes 1326 provide for vertical adjustability of the knife 1306 with respect to knife opening 1220 of the guide rail 122.

The slitting mechanism 118 includes a blade shield 1328. The blade shield 1328 covers a first portion of the cutting edge of the knife 1306 such that only a second portion of the cutting edge is exposed. The blade shield 1328 is secured to the slitting mechanism 118 via the double bearing assembly 1318.

Referring again to FIG. 12, after the tobacco rod passes the slitting mechanism 118, the tobacco rod is guided out of the channel 1218 by the transportation belt 302 and into the exit ramp 1222 of the exit plate 1206. The exit ramp 1222 guides the tobacco rod out of the guide rail 122, where the tobacco rod is transported off of the base 102 (e.g., into a holding bin adjacent to the tobacco recovery machine 100).

The above-described tobacco recovery machine 100 provides a single machine that deconstructs formed cigarettes. The tobacco recovery machine 100 includes both the chopping mechanism 116 that separates the filter rod from the tobacco rod, and the slitting mechanism 118 that slits the tipping paper surrounding the tobacco rod such that the tobacco product can be removed from the formed cigarettes in an efficient manner.

Method of Separating Tobacco from Formed Cigarettes

In various embodiments, the invention described herein relates to a method of separating tobacco product from cigarettes (e.g., through the tobacco recovery machine 100 described above with respect to FIGS. 1 through 13C).

Referring to FIG. 14, a flow diagram of a method 1400 of separating the tobacco product from a cigarette is shown according to an example embodiment. The method 1400 is performed by the tobacco recovery machine 100, which is described above in detail. Method 1400 begins when cigarettes are received for processing in the hopper 106 of the tobacco recovery machine 100 at 1402. Each of the cigarettes includes a filter rod and a tobacco rod surrounded by tipping paper. The cigarettes are loaded into the hopper 106 such that the filter rod of each of the cigarettes is facing the same direction (e.g., such that the filter rod is adjacent to the back plate 508 of the receiving compartment 510 and such that the tobacco rod is adjacent to the door wall 520 of the receiving compartment 510).

The cigarettes are individually fed out of the hopper at 1404. The feed drum 110 and the refuser roller 112 individually feed the cigarettes from the hopper 106 such that a given cigarette is received in one of the plurality of first grooves 604 of the feed drum 110. Each cigarette is held within a respective one of the plurality of the first grooves 604 by the guide assembly 114 as the feed drum 110 rotates.

For each cigarette, the filter rod is separated from the cigarette at 1406. As the feed drum 110 rotates, the feed drum 110 routes each cigarette past the chopping mechanism 116. The knife 906 of the chopping mechanism 116 extends into one of the second plurality of groves 606 of the feed drum such that when a cigarette is rotated past the knife 906, the knife 906 separates the filter rod of each cigarette from the tobacco rod. During the separation of the filter rod from the cigarette, the knife 906 is rotated by the motor 902. The separated filter rod is routed to the filter catch bin 408 at 1408. As the feed drum 110 continues to rotate, the separated filter rod is routed into the filter catch bin 408 by the filter rod rail 806 of the guide assembly 114.

The tobacco rod is deposited into the transportation mechanism at 1410. As the feed drum 110 rotates, the tobacco rod rails 804 of the guide assembly route the tobacco rod of each cigarette into the entrance guide 1216 of the guide rail 122. The entrance guide 1216 aligns the tobacco rod properly for passage through the channel 1218 of the guide rail 122.

The tipping paper surrounding the tobacco rod is slit at 1412. The transportation belt 302 of the mechanism propels the tobacco rod through the channel 1218 of the guide rail 122. As the tobacco rod travels through the channel 1218, the tobacco rod passes the rotating knife 1306 of the slitting mechanism 118. The rotating knife 1306 extends through the knife opening 1220 of the guide rail 122. The rotating knife 1306 extends into the channel 1218 such that the tipping paper surrounding the tobacco rod is slit along the axis of the tobacco rod. Accordingly, after the tipping paper is slit, the tobacco product within the tobacco rod can be easily separated from the tipping paper.

The tobacco rod is routed out of the tobacco recovery machine 100 at 1414. The transportation belt 302 carries the tobacco rod and the split tipping paper out of the channel 1218 and down the exit ramp 1222. As shown in FIG. 1, the transportation belt 302 extends to the end of the base 102, where the tobacco rod and split tipping paper are transported off of the base 102 (e.g., into a receiving bin placed adjacent to the tobacco recovery machine 100).

Many modifications and other aspects of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific aspects disclosed and that equivalents, modifications, and other aspects are intended to be included within the scope of the appended claims. Although specific terms are employed herein, they are used in a generic and descriptive sense only and not for purposes of limitation.

That which is claimed:

1. A tobacco recovery machine comprising:

a feeder configured to individually transport a plurality of cigarettes past a chopping mechanism, each of the plurality of cigarettes including a filter rod and a tobacco rod surrounded by tipping paper, the chopping mechanism including a chopping knife configured to separate the filter rod from the tobacco rod, the feeder comprising a feed drum having a curved outer surface;

a guide assembly configured to maintain individual cigarettes within the feeder as the feeder transports the individual cigarettes past the chopping mechanism, the guide assembly comprising a first tobacco rod rail, a second tobacco rod rail, and a filter rod rail, each of the first tobacco rod rail, the second tobacco rod rail, and the filter rod rail having a curvature so as to partially surround the curved outer surface of the feed drum, the first tobacco rod rail positioned adjacent to the second tobacco rod rail and separated therefrom, and the filter rod rail positioned adjacent to the first tobacco rod rail opposite the second tobacco rail, the filter rod rail separated from the first tobacco rod rail and selectively movable therefrom so as to adjust a distance therebetween; and a transportation mechanism including a belt drive system and a guide rail, the guide rail comprising:

an entrance guide comprising a first top entrance plate and a second top entrance plate positioned over a bottom entrance plate, the first and second top entrance plates defining a central opening therebetween and comprising sloping sidewalls structured to receive the tobacco rod from the guide assembly, a guide channel formed by a first top slit plate and a second top slit plate positioned over a bottom slit plate, the guide channel positioned downstream of the entrance guide, the guide channel being circular in cross-section and defining an axial knife opening between the first top slit plate and the second top slit plate, and an exit ramp positioned downstream of the guide channel, the exit ramp having a first end proximate to the guide channel and defining a first cross-section, and a second end distal from the guide channel and defining a second cross-section larger than the first cross-section, and the belt drive system comprising a transportation belt positioned so as to pass between the bottom entrance plate and the first and second top entrance plates, and to also pass between the bottom slit plate and the first and second top slit plates, the transportation mechanism configured to receive the tobacco rod surrounded by the tipping paper, after the filter rod has been separated from the tobacco rod by the chopping mechanism, and to transport the tobacco rod surrounded by the tipping paper past a slitting mechanism, the slitting mechanism including a slitting knife oriented so as to axially slit the tipping paper surrounding the tobacco rod through the axial knife opening as the tobacco rod is transported past the slitting mechanism by the transportation mechanism.

2. The tobacco recovery machine of claim 1, wherein the feed drum has a substantially cylindrical body with a plurality of first grooves that extend axially across an outer surface of the feed drum, each of the first plurality of grooves sized and shaped to receive one of the cigarettes.

3. The tobacco recovery machine of claim 2, wherein the feed drum includes a second groove that extends radially around the outer surface of the feed drum, wherein the chopping knife extends into the second groove.

4. The tobacco recovery machine of claim 1, wherein the transportation belt of the belt drive system passes through the guide channel.

5. The tobacco recovery machine of claim 1, wherein the filter rod rail is configured to route the filter rod to a filter catch bin after the filter rod is separated from the tobacco rod.

6. The tobacco recovery machine of claim 1, wherein the first tobacco rod rail and the second tobacco rod rail are configured to route the tobacco rod to the guide rail of the transportation mechanism after the tobacco rod is separated from the filter rod.

7. The tobacco recovery machine of claim 1, further comprising a hopper configured to receive the plurality of cigarettes in a receiving compartment, wherein the feeder individually transports the plurality of cigarettes from the receiving compartment, past the chopping mechanism, and to the transportation mechanism.

8. The tobacco recovery machine of claim 7, wherein the feeder is mounted to the hopper.

9. The tobacco recovery machine of claim 7, wherein the chopping mechanism is mounted to the hopper.

10. The tobacco recovery machine of claim 7, wherein the receiving compartment includes a sloped bottom surface such that gravity forces the plurality of cigarettes in the receiving compartment towards the feeder.

11. A method of recovering tobacco from a plurality of cigarettes with a tobacco recovery machine, each of the cigarettes including a filter rod and a tobacco rod surrounded by tipping paper, the method comprising:

individually transporting, by a feeder, each of the plurality of cigarettes to a chopping mechanism, the feeder comprising a feed drum having a curved outer surface;

maintaining, by a first tobacco rod rail, a second rod rail and a filter rod rail of a guide assembly, individual cigarettes within the feeder as the feeder transports the individual cigarettes past the chopping mechanism, each of the first tobacco rod rail, the second tobacco rod rail, and the filter rod rail having a curvature so as to partially surround the curved outer surface of the feed drum, the first tobacco rod rail positioned adjacent to the second tobacco rod rail and separated therefrom, and the filter rod rail positioned adjacent to the first tobacco rod rail opposite the second tobacco rail, the filter rod rail separated from the first tobacco rod rail and selectively movable therefrom so as to adjust a distance therebetween;

separating, by a chopping knife of the chopping mechanism, the filter rod from the tobacco rod for each of the plurality of cigarettes;

transporting, by a transportation mechanism including a belt drive system and a guide rail, the tobacco rod surrounded by the tipping paper to a slitting mechanism, the guide rail comprising an entrance guide comprising a first top entrance plate and a second top entrance plate positioned over a bottom entrance plate, the first and second top entrance plates defining a central opening therebetween and comprising sloping sidewalls structured to receive the tobacco rod from the guide assembly, a guide channel formed by a first top slit plate and a second top slit plate positioned over a bottom slit plate, the guide channel positioned downstream of the entrance guide, the guide channel being circular in cross-section and defining an axial knife opening between the first top slit plate and the second top slit plate, and an exit ramp positioned downstream of the guide channel, the exit ramp having a first end proximate to the guide channel and defining a first cross-section, and a second end distal from the guide channel and defining a second cross-section larger than the first cross-section, and the belt drive system comprising a transportation belt positioned so as to pass between the bottom entrance plate and the first and second top entrance plates, and to also pass between the bottom slit plate and the first and second top slit plates; and slitting, by a slitting knife of the slitting mechanism, the tipping paper surrounding the tobacco rod as the tobacco rod is transported past the slitting mechanism by the transportation mechanism.

12. The method of claim 11, further comprising receiving the plurality of cigarettes in a hopper, wherein the feeder individually transports the each of the plurality of cigarettes from the hopper, past the chopping mechanism, and to the transportation mechanism.

13. The method of claim 11, further comprising guiding, by the guide assembly, the filter rod from each of the plurality of cigarettes to a filter catch bin after the filter rod is separated from the tobacco rod.

14. The method of claim 11, further comprising guiding, by the guide assembly, the tobacco rod from each of the plurality of cigarettes to the guide rail of the transportation mechanism after the tobacco rod is separated from the filter rod.

15. The method of claim 11, wherein separating the filter rod from the tobacco rod for each of the plurality of cigarettes includes rotating the chopping knife.

16. The method of claim 11, wherein slitting the tipping paper includes rotating the slitting knife.

17. The method of claim 11, further comprising routing, by the transportation mechanism, the tobacco rod out of the tobacco recovery machine.

18. The method of claim 17, wherein routing the tobacco rod out of the tobacco recovery machine includes routing the tobacco rod into a collection bin.

* * * * *